US008183772B2

(12) United States Patent
Ray et al.

(10) Patent No.: US 8,183,772 B2
(45) **Date of Patent: *May 22, 2012**

(54) STATIC AND ADDRESSABLE EMISSIVE DISPLAYS

(75) Inventors: William Johnstone Ray, Fountain Hills, AZ (US); Mark David Lowenthal, Gilbert, AZ (US); Timothy Charles Claypole, Swansea (GB)

(73) Assignee: NthDegree Technologies Worldwide Inc, Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/753,888

(22) Filed: Apr. 4, 2010

(65) Prior Publication Data

US 2010/0308719 A1 Dec. 9, 2010

Related U.S. Application Data

(63) Continuation of application No. 11/485,031, filed on Jul. 12, 2006, now Pat. No. 7,719,187, which is a continuation-in-part of application No. 11/023,064, filed on Dec. 27, 2004, now abandoned, and a continuation-in-part of application No. 11/181,488, filed on Jul. 13, 2005, now abandoned, and a continuation-in-part of application No. PCT/US2005/046895, filed on Dec. 22, 2005, said application No. 11/181,488 is a continuation of application No. 11/023,064, filed on Dec. 27, 2004, now abandoned, said application No. PCT/US2005/046895 is a continuation of application No. 11/023,064, filed on Dec. 27, 2004, now abandoned, and a continuation of application No. 11/181,488, filed on Jul. 13, 2005, now abandoned.

(51) Int. Cl.
*H05B 33/06* (2006.01)
*H05B 33/04* (2006.01)

(52) U.S. Cl. ..... 313/512; 313/503; 313/505; 313/506; 313/509; 313/169.3

(58) Field of Classification Search ..... None
See application file for complete search history.

(56) References Cited

U.S. PATENT DOCUMENTS 4,020,389 A 4/1977 Dickson et al.

(Continued)

FOREIGN PATENT DOCUMENTS

JP 11292601 A * 10/1999

(Continued)

OTHER PUBLICATIONS

Hsi-Jen J. Yeh & John Smith, Fluidic Self-Assembly for the Integration of GaAs Light-Emitting Diodes on Si Substrates, IEEE Photonics Technology Letters, vol. 6, No. 6, Jun. 1994, pp. 706-708.

(Continued)

*Primary Examiner* — Sikha Roy
(74) *Attorney, Agent, or Firm* — Nancy R. Gamburd; Gamburd Law Group LLC

(57) ABSTRACT

The various embodiments of the invention provide an addressable or a static emissive display comprising a plurality of layers, including a first substrate layer, wherein each succeeding layer is formed by printing or coating the layer over preceding layers. Exemplary substrates include paper, plastic, rubber, fabric, glass, ceramic, or any other insulator or semiconductor. In an exemplary embodiment, the display includes a first conductive layer attached to the substrate and forming a first plurality of conductors; various dielectric layers; an emissive layer; a second, transmissive conductive layer forming a second plurality of conductors; a third conductive layer included in the second plurality of conductors and having a comparatively lower impedance; and optional color and masking layers. Pixels are defined by the corresponding display regions between the first and second plurality of conductors. Various embodiments are addressable, have a substantially flat form factor with a thickness of 1-3 mm, and are also scalable virtually limitlessly, from the size of a mobile telephone display to that of a billboard.

48 Claims, 17 Drawing Sheets

U.S. PATENT DOCUMENTS

| | | | | |
|---|---|---|---|---|
| 4,074,299 | A | 2/1978 | Kusano et al. | |
| 4,152,624 | A | 5/1979 | Knaebel | |
| 4,153,905 | A | 5/1979 | Charmakadze et al. | |
| 4,316,208 | A | 2/1982 | Kobayashi et al. | |
| 4,347,262 | A | 8/1982 | Marcus | |
| 4,396,929 | A | 8/1983 | Ohki et al. | |
| 4,407,320 | A | 10/1983 | Levine | |
| 4,626,567 | A * | 12/1986 | Chang | 524/493 |
| 4,638,110 | A | 1/1987 | Erbert | |
| 4,755,485 | A | 7/1988 | Tsai | |
| 4,761,720 | A | 8/1988 | Solow | |
| 4,767,966 | A | 8/1988 | Simopoulos et al. | |
| 4,919,506 | A | 4/1990 | Covey | |
| 5,028,546 | A | 7/1991 | Hotchkiss | |
| 5,113,232 | A | 5/1992 | Itoh et al. | |
| 5,214,306 | A | 5/1993 | Hashimoto | |
| 5,376,580 | A | 12/1994 | Kish et al. | |
| 5,408,120 | A | 4/1995 | Manabe et al. | |
| 5,469,020 | A | 11/1995 | Herrick | |
| 5,507,404 | A * | 4/1996 | Ryu | 216/24 |
| 5,545,291 | A | 8/1996 | Smith et al. | |
| 5,634,835 | A | 6/1997 | Wu et al. | |
| 5,641,611 | A | 6/1997 | Shieh et al. | |
| 5,756,147 | A * | 5/1998 | Wu et al. | 427/66 |
| 5,786,664 | A | 7/1998 | Youmin | |
| 5,793,455 | A | 8/1998 | Nakamura | |
| 5,904,545 | A | 5/1999 | Smith et al. | |
| 5,932,327 | A | 8/1999 | Inoguchi et al. | |
| 5,976,613 | A | 11/1999 | Janusauskas | |
| 5,990,984 | A | 11/1999 | Meredith et al. | |
| 6,066,513 | A | 5/2000 | Pogge et al. | |
| 6,107,671 | A | 8/2000 | Onodera | |
| 6,118,426 | A | 9/2000 | Albert et al. | |
| 6,203,391 | B1 | 3/2001 | Murasko et al. | |
| 6,274,508 | B1 | 8/2001 | Jacobsen et al. | |
| 6,281,038 | B1 | 8/2001 | Jacobsen et al. | |
| 6,291,266 | B1 | 9/2001 | Sayyah | |
| 6,291,896 | B1 | 9/2001 | Smith | |
| 6,312,304 | B1 | 11/2001 | Duthaler et al. | |
| 6,316,278 | B1 | 11/2001 | Jacobsen et al. | |
| 6,331,063 | B1 | 12/2001 | Kamada et al. | |
| 6,339,013 | B1 | 1/2002 | Naseem et al. | |
| 6,352,940 | B1 | 3/2002 | Seshan et al. | |
| 6,380,729 | B1 | 4/2002 | Smith | |
| 6,407,763 | B1 | 6/2002 | Yamaguchi et al. | |
| 6,410,940 | B1 | 6/2002 | Jiang et al. | |
| 6,417,025 | B1 | 7/2002 | Gengel | |
| 6,420,266 | B1 | 7/2002 | Smith et al. | |
| 6,424,088 | B1 | 7/2002 | Murasko et al. | |
| 6,445,489 | B1 | 9/2002 | Jacobson et al. | |
| 6,465,969 | B1 | 10/2002 | Murasko et al. | |
| 6,468,638 | B2 | 10/2002 | Jacobsen et al. | |
| 6,479,395 | B1 | 11/2002 | Smith et al. | |
| 6,479,930 | B1 | 11/2002 | Tanabe et al. | |
| 6,507,989 | B1 | 1/2003 | Bowden et al. | |
| 6,515,522 | B2 | 2/2003 | Inada et al. | |
| 6,527,964 | B1 | 3/2003 | Smith et al. | |
| 6,528,351 | B1 | 3/2003 | Nathan et al. | |
| 6,555,408 | B1 | 4/2003 | Jacobsen et al. | |
| 6,566,744 | B2 | 5/2003 | Gengel | |
| 6,583,580 | B2 | 6/2003 | Shimoda et al. | |
| 6,586,338 | B2 | 7/2003 | Smith et al. | |
| 6,588,131 | B2 | 7/2003 | O'Connell, Jr. | |
| 6,590,346 | B1 | 7/2003 | Hadley et al. | |
| 6,599,769 | B2 | 7/2003 | Kondo et al. | |
| 6,605,483 | B2 | 8/2003 | Victor et al. | |
| 6,605,902 | B2 | 8/2003 | Shimoda et al. | |
| 6,606,079 | B1 | 8/2003 | Smith | |
| 6,606,247 | B2 | 8/2003 | Credelle et al. | |
| 6,607,930 | B2 | 8/2003 | Karpov et al. | |
| 6,611,237 | B2 | 8/2003 | Smith | |
| 6,623,579 | B1 | 9/2003 | Smith et al. | |
| 6,624,569 | B1 | 9/2003 | Pennaz et al. | |
| 6,624,571 | B1 | 9/2003 | Toyoyasu et al. | |
| 6,635,306 | B2 | 10/2003 | Steckl et al. | |
| 6,639,578 | B1 | 10/2003 | Comiskey et al. | |
| 6,642,069 | B2 | 11/2003 | Armgarth et al. | |
| 6,653,157 | B2 | 11/2003 | Kondo | |
| 6,657,289 | B1 | 12/2003 | Craig et al. | |
| 6,664,560 | B2 | 12/2003 | Emerson et al. | |
| 6,665,044 | B1 | 12/2003 | Jacobsen et al. | |
| 6,680,725 | B1 | 1/2004 | Jacobson | |
| 6,683,333 | B2 | 1/2004 | Kazlas et al. | |
| 6,683,663 | B1 | 1/2004 | Hadley et al. | |
| 6,693,384 | B1 | 2/2004 | Vicentini et al. | |
| 6,696,785 | B2 | 2/2004 | Shimoda et al. | |
| 6,706,959 | B2 | 3/2004 | Hamakawa et al. | |
| 6,723,576 | B2 | 4/2004 | Nozawa et al. | |
| 6,730,990 | B2 | 5/2004 | Kondo et al. | |
| 6,731,353 | B1 | 5/2004 | Credelle et al. | |
| 6,741,025 | B2 | 5/2004 | Tuck et al. | |
| 6,777,884 | B1 | 8/2004 | Barnardo et al. | |
| 6,780,696 | B1 | 8/2004 | Schatz | |
| 6,790,692 | B2 | 9/2004 | Onozawa | |
| 6,794,221 | B2 | 9/2004 | Sayyah | |
| 6,811,714 | B1 | 11/2004 | Gorrell et al. | |
| 6,811,895 | B2 | 11/2004 | Murasko et al. | |
| 6,816,380 | B2 | 11/2004 | Credelle et al. | |
| 6,844,673 | B1 | 1/2005 | Bernkopf | |
| 6,846,565 | B2 | 1/2005 | Korgel et al. | |
| 6,850,312 | B2 | 2/2005 | Jacobsen et al. | |
| 6,863,219 | B1 | 3/2005 | Jacobsen et al. | |
| 6,864,435 | B2 | 3/2005 | Hermanns et al. | |
| 6,864,570 | B2 | 3/2005 | Smith | |
| 6,864,875 | B2 | 3/2005 | Drzaic et al. | |
| 6,875,629 | B2 | 4/2005 | Senda et al. | |
| 6,876,357 | B2 | 4/2005 | Kim | |
| 6,878,638 | B2 | 4/2005 | Regan et al. | |
| 6,896,145 | B2 | 5/2005 | Higgins et al. | |
| 6,897,139 | B2 | 5/2005 | Shibata et al. | |
| 6,898,225 | B2 | 5/2005 | Mooradian | |
| 6,918,946 | B2 | 7/2005 | Korgel et al. | |
| 6,919,225 | B2 | 7/2005 | Craig et al. | |
| 6,919,641 | B2 | 7/2005 | Onozawa et al. | |
| 6,927,085 | B2 | 8/2005 | Hadley et al. | |
| 6,927,382 | B2 | 8/2005 | King et al. | |
| 6,930,020 | B2 | 8/2005 | Sayyah | |
| 6,946,322 | B2 | 9/2005 | Brewer | |
| 6,965,196 | B2 | 11/2005 | Murasko et al. | |
| 6,970,219 | B1 | 11/2005 | Hermann | |
| 6,972,970 | B2 | 12/2005 | Yamada | |
| 6,974,604 | B2 | 12/2005 | Hunter et al. | |
| 6,980,184 | B1 | 12/2005 | Stewart et al. | |
| 6,985,361 | B2 | 1/2006 | Credelle et al. | |
| 6,988,667 | B2 | 1/2006 | Stewart et al. | |
| 7,001,639 | B2 | 2/2006 | Murasko et al. | |
| 7,007,370 | B2 | 3/2006 | Gracias et al. | |
| 7,015,479 | B2 | 3/2006 | Haas et al. | |
| 7,018,575 | B2 | 3/2006 | Brewer et al. | |
| 7,030,412 | B1 | 4/2006 | Drzaic et al. | |
| 7,045,446 | B2 | 5/2006 | Onozawa et al. | |
| 7,046,328 | B2 | 5/2006 | Jacobsen et al. | |
| 7,061,556 | B2 | 6/2006 | Sugihara et al. | |
| 7,064,356 | B2 | 6/2006 | Stefanov et al. | |
| 7,070,851 | B2 | 7/2006 | Jacobsen et al. | |
| 7,071,629 | B2 | 7/2006 | Russ et al. | |
| 7,080,444 | B1 | 7/2006 | Craig et al. | |
| 7,091,939 | B2 | 8/2006 | Kasai | |
| 7,095,477 | B2 | 8/2006 | Liang et al. | |
| 7,101,502 | B2 | 9/2006 | Smith et al. | |
| 7,113,250 | B2 | 9/2006 | Jacobsen et al. | |
| 7,115,971 | B2 | 10/2006 | Stumbo et al. | |
| 7,133,431 | B2 | 11/2006 | Onozawa et al. | |
| 7,141,176 | B1 | 11/2006 | Smith et al. | |
| 7,172,789 | B2 | 2/2007 | Smith et al. | |
| 7,172,910 | B2 | 2/2007 | Hadley et al. | |
| 7,198,978 | B2 | 4/2007 | Onozawa | |
| 7,199,527 | B2 | 4/2007 | Holman | |
| 7,202,505 | B2 | 4/2007 | Nurminen et al. | |
| 7,214,569 | B2 | 5/2007 | Swindlehurst et al. | |
| 7,218,041 | B2 | 5/2007 | Isoda | |
| 7,218,048 | B2 | 5/2007 | Choi et al. | |
| 7,218,527 | B1 | 5/2007 | Jacobsen | |
| 7,223,635 | B1 | 5/2007 | Brewer | |
| 7,236,366 | B2 | 6/2007 | Chen | |
| 7,238,966 | B2 | 7/2007 | Nakata | |
| 7,244,326 | B2 | 7/2007 | Craig et al. | |

7,244,960 B2 7/2007 Spreitzer et al.
7,251,882 B2 8/2007 Ricks et al.
7,252,781 B2 8/2007 Spreitzer et al.
7,253,091 B2 8/2007 Brewer et al.
7,260,882 B2 8/2007 Credelle et al.
7,273,663 B2 9/2007 Liao et al.
7,288,432 B2 10/2007 Jacobsen et al.
7,321,159 B2 1/2008 Schatz
7,323,757 B2 1/2008 Fonstad, Jr. et al.
7,327,078 B2 2/2008 Setlur et al.
7,329,945 B2 2/2008 Moden
7,332,361 B2 2/2008 Lu et al.
7,351,660 B2 4/2008 Brewer et al.
7,353,598 B2 4/2008 Craig et al.
7,356,952 B2 4/2008 Sweeney et al.
7,381,591 B2 6/2008 Moden
7,382,363 B2 6/2008 Albert et al.
7,396,142 B2 7/2008 Laizure, Jr. et al.
7,417,306 B1 8/2008 Jacobsen et al.
7,425,467 B2 9/2008 Jacobsen et al.
7,452,748 B1 11/2008 Craig et al.
7,453,705 B2 11/2008 Tolt
7,489,248 B2 2/2009 Gengel et al.
7,491,969 B2 2/2009 Wu et al.
7,500,307 B2 3/2009 Munn
7,501,955 B2 3/2009 Forster et al.
7,510,672 B2 3/2009 McCulloch et al.
7,521,292 B2 4/2009 Rogers et al.
7,521,340 B2 4/2009 Lemmi et al.
7,531,218 B2 5/2009 Smith et al.
7,538,756 B2 5/2009 Kerr et al.
7,542,301 B1 6/2009 Liong et al.
7,551,454 B2 6/2009 Wuchse et al.
7,557,367 B2 7/2009 Rogers et al.
7,559,131 B2 7/2009 Credelle et al.
7,560,803 B2 7/2009 Onozawa
7,561,221 B2 7/2009 Jacobsen et al.
7,561,452 B2 7/2009 Mednik et al.
7,576,656 B2 8/2009 Craig et al.
7,595,588 B2 9/2009 Gourlay
7,605,799 B2 10/2009 Amundson et al.
7,607,812 B2 10/2009 Kim
7,615,479 B1 11/2009 Craig et al.
7,622,367 B1 11/2009 Nuzzo et al.
7,622,813 B2 11/2009 Brewer
7,623,034 B2 11/2009 Ferguson et al.
7,625,780 B2 12/2009 Jacobs et al.
7,629,026 B2 12/2009 Sharma et al.
7,645,177 B2 1/2010 Kwasny
7,662,008 B2 2/2010 Hillis et al.
7,687,277 B2 3/2010 Sharma et al.
7,698,800 B2 4/2010 Watanabe
7,704,763 B2 4/2010 Fujii et al.
7,716,160 B2 5/2010 Smith et al.
7,724,541 B2 5/2010 Gracias et al.
7,727,804 B2 6/2010 Smith
RE41,563 E 8/2010 Caron et al.
7,774,929 B2 8/2010 Jacobs
7,799,699 B2 9/2010 Nuzzo et al.
2001/0014520 A1 8/2001 Usui et al.
2001/0046652 A1 11/2001 Ostler et al.
2001/0048968 A1 12/2001 Cox et al.
2002/0001051 A1 1/2002 Krusius et al.
2002/0027230 A1 3/2002 Terada et al.
2002/0130627 A1 9/2002 Morgan et al.
2003/0090199 A1 5/2003 Saita et al.
2003/0113581 A1 6/2003 Gotou
2003/0172563 A1 9/2003 Higgins et al.
2004/0018379 A1 1/2004 Kinlen
2004/0051449 A1 3/2004 Klausmann et al.
2004/0099875 A1 5/2004 Lin
2004/0188672 A1 9/2004 Spreitzer et al.
2004/0190304 A1 9/2004 Sugimoto et al.
2004/0195576 A1 10/2004 Watanabe et al.
2004/0195967 A1 10/2004 Padiyath et al.
2004/0206939 A1 10/2004 Spreitzer et al.
2004/0218388 A1 11/2004 Suzuki
2004/0227457 A1* 11/2004 Yamashita ..... 313/503
2005/0020035 A1 1/2005 Nause et al.
2005/0029513 A1 2/2005 Kawashima et al.
2005/0067944 A1 3/2005 Masuda et al.
2005/0073849 A1 4/2005 Rhoads et al.
2005/0087131 A1 4/2005 Shtein et al.
2005/0116621 A1* 6/2005 Bellmann et al. ..... 313/503
2005/0218421 A1 10/2005 Andrews et al.
2005/0230853 A1 10/2005 Yoshikawa
2005/0249901 A1 11/2005 Yializis et al.
2006/0001055 A1 1/2006 Ueno et al.
2006/0062995 A1* 3/2006 Yamamoto ..... 428/332
2006/0105481 A1 5/2006 Boardman et al.
2006/0113510 A1 6/2006 Luo et al.
2006/0119686 A1 6/2006 Odell
2006/0130894 A1 6/2006 Gui et al.
2006/0199313 A1 9/2006 Harting et al.
2006/0238666 A1 10/2006 Ko et al.
2006/0240218 A1 10/2006 Parce
2006/0277778 A1 12/2006 Mick et al.
2006/0281341 A1 12/2006 Soeta
2007/0022644 A1 2/2007 Lynch et al.
2007/0035808 A1 2/2007 Amundson et al.
2007/0040489 A1 2/2007 Ray et al.
2007/0042614 A1 2/2007 Marmaropoulos et al.
2007/0065646 A1 3/2007 Chaimberg et al.
2007/0090383 A1 4/2007 Ota et al.
2007/0108459 A1 5/2007 Lu
2007/0110921 A1 5/2007 Angelopoulos et al.
2007/0111354 A1 5/2007 Seong et al.
2007/0126544 A1 6/2007 Wotherspoon et al.
2007/0138923 A1 6/2007 Sokola
2007/0173578 A1 7/2007 Spreitzer et al.
2007/0188483 A1 8/2007 Bonner
2008/0000122 A1 1/2008 Shotton
2008/0067475 A1 3/2008 McCulloch et al.
2008/0099772 A1 5/2008 Shuy et al.
2008/0111806 A1 5/2008 Dyrc et al.
2008/0135804 A1 6/2008 Qiu et al.
2008/0137333 A1 6/2008 Tamaoki et al.
2008/0160734 A1 7/2008 Bertin et al.
2008/0169753 A1 7/2008 Skipor et al.
2008/0191198 A1 8/2008 Han et al.
2008/0199600 A1 8/2008 Spreitzer et al.
2008/0220288 A1 9/2008 De Kok et al.
2008/0223428 A1 9/2008 Zeira
2008/0248307 A1 10/2008 Jurbergs et al.
2008/0261341 A1 10/2008 Zimmerman et al.
2008/0265789 A1 10/2008 Bertram et al.
2008/0289688 A1 11/2008 Hammerbacher et al.
2008/0297453 A1 12/2008 Ray et al.
2009/0014056 A1 1/2009 Hockaday
2009/0050921 A1 2/2009 Bierhuizen et al.
2009/0072245 A1 3/2009 Noe et al.
2009/0074649 A1 3/2009 Korgel et al.
2009/0140279 A1 6/2009 Zimmerman et al.
2009/0168403 A1 7/2009 Chang et al.
2009/0217970 A1 9/2009 Zimmerman et al.
2009/0236616 A1 9/2009 Ku
2009/0242916 A1 10/2009 Hsu et al.
2009/0294786 A1 12/2009 Jan et al.
2009/0303715 A1 12/2009 Takasago et al.
2010/0060553 A1 3/2010 Zimmerman et al.
2010/0247893 A1 9/2010 Zimmerman

FOREIGN PATENT DOCUMENTS

JP 2003203761 A * 7/2003
WO WO 99/39552 A1 8/1999
WO WO 00/72638 A1 11/2000
WO WO 01/16995 A1 3/2001

OTHER PUBLICATIONS

George M. Whitesides et al, Self-Assembly at All Scales, Science, vol. 295, Mar. 29, 2002, pp. 2418-2421.

Suk Tai Chang et al, Remotely powered self-propelling particles and micropumps based on miniature diodes, Nature Materials, vol. 6, Mar. 2007, pp. 235-240 and Supplementary Information pp. 1-7.

Sang-Il Park et al., Printed Assemblies of Inorganic Light-Emitting Diodes for Deformable and Semitransparent Displays, Science, vol.

325, Aug. 21, 2009, pp. 977-981, and Supporting Online Material, http://www.sciencemag.org/content/suppl/2009/08/20/325.5943.977.DC1, pp. 1-44.
Jong-Hyun Ahn, et al, Heterogeneous Three-Dimensional Electronics by Use of Printed Semiconductor Nanomaterials, Science, vol. 314, Dec. 15, 2006, pp. 1754-1757.
Paul Calvert, Inkjet Printing for Materials and Devices, Chem. Mater, vol. 13, Sep. 12, 2001, pp. 3299-3305.
Sean A. Stauth et al., Self-assembled single-crystal silicon circuits on plastic, PNAS, vol. 103, No. 38, Sep. 19, 2006, pp. 13922-13927.
David R. Allee et al, Circuit-Level Impact of a-Si:H Thin-Film-Transistor Degradation Effects, IEEE Transactions on Electron Devices, Jun. 2009, pp. 1166-1176, vol. 56.
Koyo Horiuchi et al, Profile Controlled Laser Doping for N-Type Silicon Solar Cells, Graduate School of Materials Science, Nara Institute of Science & Technology; pp. 1-4; http://www.energy-based.nrct.go.th/Article/Ts-3%20profile%20controlled%20laser%20doping%20for%20n-type%20silicon%20solar%20cells.pdf, 2007.
D.L. Meier et al, Self-Doping Contacts & Associated Silicon Solar Cell Structures, Crystalline Silicon Solar Cells & Technologies, 2nd World Conference and Exhibition on Photovoltaic Solar Energy Conversion, Vienna, Austria, Jul. 6-10, 1998, pp. 1491-1494.
Jeff C. Gelpey et al, Advanced Annealing for Sub-130nm Junction Formation, Vortek Industries Ltd., Vancouver, BC, http://www.vsea.com/pubs.nsf/0/5b03aafeb1918db485256caf0052a889/$FILE/VSEA5_DowneyArevalo.pdf; pp. 1-12, Nov. 2011.
Roberto Fenollosa et al., Optical microcavities and photonic sponges based on silicon spheres, http://deeea.urv.cat/DEEEA/cen2008/docs/Fenollosa_UPV_01.pdf, pp. 1-2, 2008.
Researchers develop new method for producing transparent conductors, http://www.physorg.com/print161456665.html, p. 1, May 2009.
Zhijian Z. J. Lu et al., Wide-angle film diffuser, Journal of the Society for Information Display (SID), 15/8, 2007, pp. 565-569.
I. S. Tsai et al., Film surface morphology and field-emission characteristics of a carbon-nanotube array pattern fabricated under a magnetic field, Journal of the Society for Information Display (SID), 16/5, 2008, pp. 639-644.
Yiru Sun et al., Enhanced light out-coupling of organic light-emitting devices using embedded low-index grids, Nature Photonics, vol. 2, pp. 483-487, published online Jul. 11, 2008, http://www.nature.com/nphoton/journal/v2/n8/full/nphoton.2008.132.html.
H.W. Choi et al., Mechanism of enhanced light output efficiency in InGaN-based microlight emitting diodes, Journal of Applied Physics, vol. 93, No. 10, May 15, 2003, pp. 5978-5982.
Emmanuel Van Kerschaver et al., Back-contact Solar Cells: A Review, Prog.Photovolt: Res. Appl. 2006; 14:107-123.
Paul T. Fini et al., High-Efficiency Nitride-Based Solid State Lighting, Final Technical Progress Report, DoE Award No. De-FC26-01NT41203, Jul. 30, 2005, pp. 1-132, http://www.osti.gov/bridge/servlets/purl/877537-2wWdpN/877537.pdf.
Z. Y. Fan et al., III-nitride micro-emitter arrays: development and applications, J. Phys. D: Appl. Phys. 41 (2008) 094001 (12 pp), pp. 1-12.
H. X. Jiang et al., Advances in III-Nitride Microstructures and Micro-Size Emitters, Journal of the Korean Physical Society, vol. 42, Feb. 2003, pp. S757-S764.
Breck Hitz, Q: What Did the Scientist Say to the LED? A: Don't Be Square, Photonics Technology News, Feb. 2008, pp. 27-29.
Christoph J. Brabec et al., Solution-Processed Organic Solar Cells, MRS Bulletin, vol. 33, Jul. 2008, pp. 670-675.
Yang Cao et al., A technique for controlling the alignment of silver nanowires with an electric field, Nanotechnology 17 (2006), pp. 2378-2380.
Saving Silicon, Nature Photonics, vol. 1, Oct. 2007, pp. 558-559.
D.R. McCamey et al., Spin Rabi flopping in the photocurrent of a polymer light-emitting diode, Nature Materials, vol. 7, Sep. 2008, pp. 723-728.
Xiang Zhang et al., Superlenses to overcome the diffraction limit, Nature Materials, vol. 7, Jun. 2008, pp. 435-441.
Aristeidis Karalis et al., Efficient wireless non-radiative mid-range energy transfer, Annals of Physics 323 (2008), pp. 34-48.
Vasily N. Astratov et al., Percolation of light through whispering gallery modes in 3D lattices of coupled microspheres, Optics Express, vol. 15, No. 25, Dec. 10, 2007, pp. 17351-17361.
M.L.M. Balistreri, Visualizing the whispering gallery modes in a cylindrical optical optical microcavity, Optics Letters, vol. 24, No. 24, Dec. 15, 1999, pp. 1829-1831.
Paul Paddon et al., Enabling Solar Cells, Laser+Photonics, vol. 4, 2008, pp. 42-45.
Peter Bermel et al., Improving thin-film crystalline silicon solar cell efficiencies with photonic crystals, Optics Express, vol. 15, No. 25, Dec. 10, 2007, pp. 16986-17000.
Committee on Nanophotonics Accessibility and Applicability, National Research Council, Nanophotonics: Accessibility and Applicability, pp. 1-237, http://www.nap.edu/catalog/11907.html, 2008.
Hoi Wai Choi et al. Whispering-gallery mode lasing in GaN microdisks, SPIE, 10.1117/2.1200707.0692, pp. 1-2, 2007.
Vladimir S. Ilchenko et al., Dispersion compensation in whispering-gallery modes, J. Opt. Soc. Am. A, vol. 20, No. 1, Jan. 2003, pp. 157-162.
Makoto Gonokami, Expanding the potential of light and materials—Combining nanotechnology with optical technology, Japan Nanonet Bulletin, 60th Issue, Dec. 22, 2005, http://www.nanonet.go.jp/english/mailmag/pdf/060a.pdf, pp. 1-3.
Bahram Jalali, Teaching silicon new tricks, Nature Photonics, vol. 1, Apr. 2007, pp. 193-195.
Eli Yablonovitch, Light Emission in Photonic Crystal Micro-Cavities, in E. Burstein et al., Confined Electrons and Photons, Plenum Press, NY, 1995, pp. 635-646, http://www.ee.ucla.edu/labs/photon/bkchaps/ey1994cepnpa635646.pdf.
Shinichi Koseki, Monolithic Waveguide Coupled GaAs Microdisk Microcavity Containing InGaAs Quantum Dots, Ph.D Defense, http://www.stanford.edu/group/yamamotogroup/slides/SKdefense.pdf, pp. 1-B15, Sep. 2008.
David H. Foster et al., Spatial and polarization structure in microdome resonators: effects of a Bragg mirror, in Alexis V. Kudryashov et al., Laser Resonators and Beam Control VII, Proceedings of SPIE 5333, pp. 195-203 (2004).
John Flintermann et al., Calculations on the Optical Properties of Layered Metal Nanospheres, Nanoscape, vol. 3, Issue 1, Spring 2006, pp. 29-37.
NASA Jet Propulsion Laboratory, Whispering Gallery Mode-Locked Lasers, http://www.techbriefs.com/index.php?option=com_staticxt&staticfile=/Briefs/Nov03/NPO30833.html, pp. 1-3, Nov. 2003.
Juha-Pekka Laine, Design and Applications of Optical Microsphere Resonators, Helsinki University of Technology Publications in Engineering Physics, Espoo, Finland, Apr. 22, 2003, http://lib.tkk.fi/Diss/2003/isbn951226448X/isbn951226448X.pdf, pp. 1-56.
Jeff Hecht,Photonic Frontiers: microcavities—The strange world of microcavity optics, http://www.optoiq.com/index/photonics-technologies-applications/lfw-display/lfw-article-display/335982/articles/optoiq2/photonics-technologies/technology-products/optical-components/micro-optics_/2009/12/photonic-frontiers-microcavities-the-strange-world-of- microcavity-optics.html, pp. 1-6, 2009.
Cherry Yee Yee Cheng, Spherical Silicon Photovoltaics: Characterization and Novel Device Structure, University of Waterloo, 2008, pp. 1-102, http://proquest.umi.com/pqdlink? Ver=1&Exp=07-24-2016&FMT=7&DID=1633772641&RQT=309&attempt=1&cfc=1.
Aliaksandr Rahachou, Theoretical studies of light propagation in photonic and plasmonic devices, Linkoping Studies in Science and Technology, Doctoral Dissertation No. 1115, Aug. 2007, pp. 1-80, http://webstaff.itn.liu.se/~alira/ITN-Diss1115-Rahachou.pdf.
Hong Luo et al., Trapped whispering-gallery optical modes in white light-emitting diode lamps with remote phosphor, Applied Physics Letters 89, 2006, pp. 041125-1-041125-3.
L. Deych et al., Rayleigh Scattering of Whispering Gallery Modes of Microspheres due to a Single Scatter: Myths and Reality, Dec. 23, 2008, pp. 1-10, http://arxiv.org/PS_cache/arxiv/pdf/0812/0812.4404v1.pdf.
Wei-Chi Lee et al., Enhanced Performance of GaN-Based Vertical Light-Emitting Diodes with Circular Protrusions Surmounted by Hexagonal Cones and Indium-Zinc Oxide Current Spreading Layer, Applied Physics Express, vol. 4, 2011, pp. 072104-1-072104-3.

* cited by examiner

STATIC AND ADDRESSABLE EMISSIVE DISPLAYS

CROSS-REFERENCE TO RELATED APPLICATIONS

This application is a continuation of and claims priority to U.S. patent application Ser. No. 11/485,031, filed Jul. 12, 2006, inventors William Johnstone Ray et al., entitled "Static and Addressable Emissive Displays" (the "first related application"), which is a continuation-in-part of and claims priority to U.S. patent application Ser. No. 11/023,064, filed Dec. 27, 2004, inventors William Johnstone Ray et al., entitled "Addressable And Printable Emissive Display", which are commonly assigned herewith, the contents of all of which are incorporated herein by reference, and with priority claimed for all commonly disclosed subject matter.

The first related application is also a continuation-in-part of and claims priority to U.S. patent application Ser. No. 11/181,488, filed Jul. 13, 2005, inventors William Johnstone Ray et al., entitled "Addressable And Printable Emissive Display", which is a continuation of U.S. patent application Ser. No. 11/023,064, filed Dec. 27, 2004, inventors William Johnstone Ray et al., entitled "Addressable And Printable Emissive Display", which are commonly assigned herewith, the contents of all of which are incorporated herein by reference, and with priority claimed for all commonly disclosed subject matter.

The first related application is also a continuation-in-part of and claims priority to PCT Application Serial No. PCT/US2005/046895, filed Dec. 22, 2005, inventors William Johnstone Ray et al., entitled "Addressable And Printable Emissive Display", which further claims priority to U.S. patent application Ser. No. 11/023,064, filed Dec. 27, 2004, inventors William Johnstone Ray et al., entitled "Addressable And Printable Emissive Display" and to U.S. patent application Ser. No. 11/181,488, filed Jul. 13, 2005, inventors William Johnstone Ray et al., entitled "Addressable And Printable Emissive Display", which are commonly assigned herewith, the contents of all of which are incorporated herein by reference, and with priority claimed for all commonly disclosed subject matter.

FIELD OF THE INVENTION

The present invention in general is related to electronic display technology and, in particular, is related to an emissive display technology capable of being printed or coated on a wide variety of substrates, and which may further be electronically addressable in various forms for real-time display of information.

BACKGROUND OF THE INVENTION

Display technologies have included television cathode ray tubes, plasma displays, and various forms of flat panel displays. Typical television cathode ray tube displays utilize an emissive coating, typically referred to as a "phosphor" on an interior, front surface, which is energized from a scanning electron beam, generally in a pattern referred to as a raster scan. Such television displays have a large, very deep form factor, making them unsuitable for many purposes.

Other displays frequently used for television, such as plasma displays, while having a comparatively flat form factor, involve a complex array of plasma cells containing a selected gas or gas mixture. Using row and column addressing to select a picture element (or pixel), as these cells are energized, the contained gas is ionized and emits ultraviolet radiation, causing the pixel or subpixel containing a corresponding color phosphor to emit light. Involving myriad gas-containing and phosphor-lined cells, these displays are complicated and expensive to manufacture, also making them unsuitable for many purposes.

Other newer display technologies, such as active and passive matrix liquid crystal displays ("LCDs"), also include such pixel addressability, namely, the capability of individually addressing a selected picture element. Such displays include a complex array of layers of transistors, LCDs, vertically polarizing filters, and horizontally polarizing filters. In such displays, there is often a light source which is always powered on and emitting light, with the light actually transmitted controlled by addressing particular LCDs within an LCD matrix. Such addressing, however, is accomplished through additional layers of transistors, which control the on and off state of a given LCD.

Currently, creation of such displays requires semiconductor fabrication techniques to create the controlling transistors, among other things. A wide variety of technologies are involved to fabricate the liquid crystal layer and various polarizing layers. LCD displays also are complicated and expensive to manufacture and, again, unsuitable for many purposes.

Using simpler fabrication techniques, electroluminescent lamp (EL) technology has provided for printing or coating emissive material, such as phosphors, in conjunction with conductive layers, to form signage and other fixed displays. For these displays, a given area is energized, and that entire area becomes emissive, providing the display lighting. Such prior art EL displays, however, do not provide any form of pixel addressability and, as a consequence, are incapable of correspondingly displaying dynamically changing information. For example, such prior art EL displays cannot display an unlimited amount of information, such as any web page which may be downloaded over the internet, or any page of a book or magazine, also for example.

Such prior art displays which are incapable of pixel addressability include those discussed in Murasko U.S. Pat. No. 6,203,391, issued Mar. 20, 2001, entitled "Electroluminescent Sign"; Murasko U.S. Pat. No. 6,424,088, issued Jul. 23, 2002, entitled "Electroluminescent Sign"; Murasko U.S. Pat. No. 6,811,895, issued Nov. 2, 2004, entitled "Illuminated Display System and Process"; and Barnardo et al. U.S. Pat. No. 6,777,884, issued Aug. 17, 2004, entitled "Electroluminescent Devices". In these displays, electrodes and emissive material are printed or coated on a substrate, in a "sandwich" of layers, in various designs or patterns. Once energized, the design or pattern is illuminated in its entirety, forming the display of fixed, unchanging information, such as for illuminated signage.

These prior art static electroluminescent displays are subject to various problems which severely limit their utility and other practical uses. For example, such prior art static electroluminescent displays are not scalable to form factors larger than a typical sheet of A4 or 8½ by 11 inch paper; in particular, the various transmissive conductive material utilized do not conduct sufficiently rapidly to illuminate larger areas, failing to energize the central portions of larger displays and thereby failing to provide corresponding illumination. In addition, such prior art static electroluminescent displays are typically designed to form a backlighting of an independently created image. For example, such prior art static electroluminescent displays require separate and independent image application, such as through image transfer of a pre-printed four color image, or independent positioning of a separate translucent sheet containing the image to be illuminated, such as separate signage printed on a clear material and overlaid upon the prior art static electroluminescent displays. Such prior art static electroluminescent displays also incapable of being fully integrated with a printed design to form an integrated display having both artwork and electroluminescent regions, particularly for detailed artwork printed at high resolution (using non-screen printing techniques), largely due to very significant variations in the surface topology of the finished displays.

Prior art static electroluminescent displays also require manufacture using multiple and very different technologies. For example, many such displays require sputtering technologies and separate lamination of various layers forming the electroluminescent lamp.

In addition, such prior art static electroluminescent displays have significant durability limitations, resulting in comparatively short usable lifetimes. For example, under typical environmental conditions having some humidity, the prior art static electroluminescent displays are subject to failure and other loss of performance. Such prior art static electroluminescent displays are also subject to significant issues of short circuits, also causing a fault condition.

As a consequence, a need remains for a scalable electroluminescent display, which may provide substantially larger form factors, suitable for applications such as outdoor signage. In addition, such an electroluminescent display should provide a printable surface, for direct application of an image to be illuminated. Such an electroluminescent display should provide for an optically or visually neutral density surface, for underlying layers to have negligible perceived visual effect. Such an electroluminescent display should also provide for significant durability with a capability to withstand typical environmental conditions, especially for outdoor applications or other applications in environments having variable conditions.

Such prior art displays also do not provide for a dynamic display of changing information, particularly for information which was not preprinted and fixed during manufacture. As a consequence, a further need remains for a dynamic emissive display which provides for pixel addressability, for the display of dynamically changing information. Such a display further should be capable of fabrication using printing or coating technologies, rather than using complicated and expensive semiconductor fabrication techniques. Such a display should be capable of fabrication in a spectrum of sizes, from a size comparable to a mobile telephone display, to that of a billboard display (or larger). Such a display should also be robust and capable of operating under a wide variety of conditions.

SUMMARY OF THE INVENTION

The various embodiments of the invention provide an addressable emissive display comprising a plurality of layers over a substrate, with each succeeding layer formed by printing or coating the layer over preceding layers. The first, substrate layer may be comprised of virtually any material, such as paper, plastic, rubber, fabric, glass, ceramic, or any other insulator or semiconductor, for example. In an exemplary embodiment, the display includes a first conductive layer attached to the substrate and forming a first plurality of conductors, followed by a first dielectric layer, an emissive layer, a second dielectric layer, a second, transmissive conductive layer forming a second plurality of conductors; a third conductive layer included in the second plurality of conductors and having a comparatively lower impedance; and optional color and masking layers. Sealing (encapsulating) and topological leveling layers are also utilized in exemplary embodiments. Pixels are defined by the corresponding display regions between the first and second plurality of conductors. Various embodiments are pixel addressable, for example, by selecting a first conductor of the first plurality of conductors and a second conductor of the second plurality of conductors. Additional embodiments further provide for electroluminescent displays which are not pixel-addressable, but which may be singularly addressable or regionally addressable (referred to herein as "static" displays).

As a light emitting display, the various embodiments of the invention have highly unusual properties. First, they may be formed by any of a plurality of conventional and comparatively inexpensive printing or coating processes, rather than through the highly involved and expensive semiconductor fabrication techniques, such as those utilized to make LCD displays, plasma displays, or alternating-current thin-film electroluminescent ("ACTFEL") displays. The invention may be embodied using comparatively inexpensive materials, such as paper and phosphors (e.g., commercially available doped zinc sulfides, etc.), substantially reducing production costs and expenses. The ease of fabrication using printing processes, combined with reduced materials costs, may revolutionize display technologies and the industries which depend upon such displays, from computers to mobile telephones to financial exchanges.

Yet additional advantages of the invention are that the various embodiments are scalable, virtually limitlessly, while having a substantially flat form factor. For example, the various embodiments may be scaled up to wallpaper, billboard or larger size, or down to cellular telephone or wristwatch display size. At the same time, the various embodiments have a substantially flat form factor, with the total display thickness in the range of 50-55 microns, plus the additional thickness of the selected substrate, resulting in a display thickness on the order of 1-3 millimeters. For example, using 3 mill paper (approximately 75 microns thick), the thickness of the resulting display is on the order of 130 microns, providing one of, if not the, thinnest addressable display to date.

In addition, the various embodiments provide a wide range of selectable resolutions and are highly and unusually robust under a wide variety of environmental conditions. The various exemplary embodiments also provide an electroluminescent display having sealed or encapsulated conductive and emissive regions, providing significant durability and capability to withstand a wide variety of environmental conditions and other sources of stress or degradation. The encapsulation techniques of the exemplary embodiments further allow packaging flexibility of the finished display; for example, the displays are not required to be separately sealed behind glass or plastic for consumer handling and use.

The various exemplary embodiments also provide an electroluminescent display having a substantially topologically uniform and printable surface, for direct application of an image to be illuminated. For example, the display surface may be formed to have both a surface chemically compatible with and suitable for conventional printing, and a surface having a topological variance of 4 microns or less, allowing for direct printing using virtually any printing technology, with a higher variance within tolerance for other printing technologies, such as screen printing. An exemplary electroluminescent display also provides for an optically or visually neutral density surface, for underlying layers to have negligible perceived visual effect. This has the further effect of eliminating any need for a separate masking or background layer found in prior art static electroluminescent displays.

In a first exemplary embodiment of the invention, an emissive display comprises: a substrate; a first plurality of conductors coupled to the substrate; a first dielectric layer coupled to the first plurality of conductors; an emissive layer coupled to the first dielectric layer; and a second plurality of conductors coupled to the emissive layer, wherein the second plurality of conductors are, at least partially, adapted to transmit visible light. Such an emissive display is adapted to emit visible light from the emissive layer through the second plurality of conductors when a first conductor of the first plurality of conductors and a second conductor of the second plurality of conductors are energized.

In the first exemplary embodiment, the first plurality of conductors may be substantially parallel in a first direction, and the second plurality of conductors may be substantially parallel in a second direction, with the second direction being different than the first direction. For example, the first plurality of conductors and the second plurality of conductors may be disposed to each other in substantially perpendicular directions, such that a region substantially between a first conductor of the first plurality of conductors and a second conductor of the second plurality of conductors defines a picture element (pixel) or subpixel of the emissive display. The pixel or subpixel of the emissive display is selectively addressable by selecting the first conductor of the first plurality of conductors and selecting the second conductor of the second plurality of conductors. Such selection may be an application of a voltage, wherein the addressed pixel or subpixel of the emissive display emits light upon application of the voltage.

In the first exemplary embodiment of the invention, a third plurality of conductors may be coupled correspondingly to the second plurality of conductors, where the third plurality of conductors has an impedance comparatively lower than the impedance of the second plurality of conductors. For example, each conductor of the third plurality of conductors may comprise at least two redundant conductive paths and be formed from a conductive ink. Alternatively, each conductor of the third plurality of conductors may comprise at least one conductive path (e.g., forming a single wire) and be formed from a conductive ink or a conductive polymer. Other variations are also utilized for the third conductor, which may also be formed as a third conductive layer. For example, for static displays having a comparatively larger form factor, the third conductor may be provided in a grid pattern overlaying or embedded within the one or more second conductors.

Additional layers of the first exemplary embodiment of the invention may include a color layer coupled to the second conductive layer, with the color layer having a plurality of red, green and blue pixels or subpixels; a masking layer coupled to the color layer, the masking layer comprising a plurality of opaque areas adapted to mask selected pixels or subpixels of the plurality of red, green and blue pixels or subpixels; a calcium carbonate coating layer; and other sealing layers. In an exemplary embodiment, the color layer comprises at least one fluorescent ink, pigment or other type of fluorescent coloration, or more generally, a color conversion dye, pigment or material. As used herein, such compounds which convert ultraviolet (uv) light to visible light or convert visible light to different wavelengths will be individually and collectively referred to generally as "color conversion materials". In another exemplary embodiment, when the color layer comprises at least one fluorescent ink, pigment or other type of fluorescent coloration, a sealing layer may be non-transmissive to ultraviolet light, such that the fluorescent colorants do not appear as fluorescent to a typical observer and instead appear as non-fluorescent red, green, blue or other colors. Such electroluminescent displays do not fluoresce under ambient conditions (such as when the display is powered off), and uv emissions are largely blocked when the display is powered on.

In a second exemplary embodiment of the invention, an emissive display comprises: a substrate; a first conductive layer coupled to the substrate; a first dielectric layer coupled to the first conductive layer; an emissive layer coupled to the first dielectric layer; a second dielectric layer coupled to the emissive layer; a second, transmissive conductive layer coupled to the second dielectric layer; and a third conductive layer coupled to the second transmissive conductive layer, the third conductive layer having a comparatively lower impedance than the second transmissive conductive layer.

In a third exemplary embodiment of the invention, an emissive display comprises: a substrate; a first conductive layer coupled to the substrate, the first conductive layer comprising a first plurality of electrodes and a second plurality of electrodes, the second plurality of electrodes electrically insulated from the first plurality of electrodes; a first dielectric layer coupled to the first conductive layer; an emissive layer coupled to the first dielectric layer; a second dielectric layer coupled to the emissive layer; and a second, transmissive conductive layer coupled to the second dielectric layer. The second transmissive conductive layer may be further coupled to the second plurality of electrodes, such as through an electrical via connection, direct connection (e.g., overlaid), or by abutment. The emissive display of the third exemplary embodiment is adapted to emit visible light from the emissive layer when the first plurality of electrodes, second plurality of electrodes, and the second, transmissive conductive layer are energized.

In a fourth exemplary embodiment of the invention, an emissive display comprises: a substrate; a first plurality of conductors coupled to the substrate; a first dielectric layer coupled to the first plurality of conductors, the first dielectric layer having a plurality of reflective interfaces; an emissive layer coupled to the first dielectric layer and the plurality of reflective interfaces; and a second plurality of conductors coupled to the emissive layer, wherein the second plurality of conductors are, at least partially, adapted to transmit visible light. In this exemplary embodiment, the plurality of reflective interfaces are metal, metal flakes, such as those formed by printing a metal flake ink, or may be comprised of a compound or material which has a refractive index different from refractive indices of the first dielectric layer and the emissive layer. When a region substantially between a first conductor of the first plurality of conductors and a second conductor of the second plurality of conductors defines a picture element (pixel) or subpixel of the emissive display, in this embodiment, at least one reflective interface of the plurality of reflective interfaces is within each pixel or most pixels.

In another exemplary embodiment of the invention, a method of fabricating an emissive display comprises: using a conductive ink or conductive polymer, printing a first conductive layer, in a first selected pattern, on a substrate; printing a first dielectric layer over the first conductive layer; printing an emissive layer over the first dielectric layer; printing a second dielectric layer over the emissive layer; printing a second, transmissive conductive layer, in a second selected pattern, over the second dielectric layer; and using a conductive ink conductive polymer, printing a third conductive layer over the second transmissive conductive layer, wherein the third conductive layer has a comparatively lower impedance than the second transmissive conductive layer. The step of printing the third conductive layer may also include printing a conductive ink or conductive polymer in a third selected pattern having a single electrical path or having at least two redundant conductive paths, and the step of printing the first dielectric layer may also include printing a plurality of reflective interfaces. The exemplary method embodiment may also comprise printing one or more sealing (encapsulating) and topological leveling layers, and printing a color layer over the second dielectric layer, a second conductive layer or a third conductive layer, with the color layer comprising a plurality of red, green and blue pixels or subpixels. A masking layer may also be printed in a fourth selected pattern over the color layer, the masking layer comprising a plurality of opaque areas adapted to mask selected pixels or subpixels of the plurality of red, green and blue pixels or subpixels.

In the exemplary method embodiment, the first selected pattern defines a first plurality of conductors disposed in a first orientation or direction, and the second selected pattern defines a second plurality of conductors disposed in a second, different orientation or direction. For example, the first and second pluralities of conductors may have a perpendicular orientation to each other. In the exemplary method embodiment of the invention, the step of printing the first conductive layer may further comprise printing a first plurality of conductors, and the step of printing the second conductive layer may further comprise printing a second plurality of conductors disposed to the first plurality of conductors in a substantially perpendicular direction to create a region substantially between a first conductor of the first plurality of conductors and a second conductor of the second plurality of conductors which defines a picture element (pixel) or subpixel of the emissive display.

In another exemplary embodiment of the invention, an emissive display comprises: a substrate; a first sealing layer coupled to the substrate; a first plurality of conductors coupled to the first sealing layer; a dielectric layer coupled to the first plurality of conductors; an emissive layer coupled to the dielectric layer; and a second, optically transmissive conductor coupled to the emissive layer. In this embodiment, the second, optically transmissive conductor is coupled to a first conductor of the first plurality of conductors. The exemplary embodiment may also include a second sealing layer coupled to the second, optically transmissive conductor.

The first sealing layer and the second sealing layer are generally comprised of a hydrophobic compound, such as a lacquer-based compound or a nanoparticle carbon coating, and may further include a colorant, such as a colorant having a neutral density substantially corresponding to a neutral density of the first plurality of conductors.

The exemplary embodiment may also include at least one topological leveling layer coupled to the first plurality of conductors, coupled to the dielectric layer, coupled to both the first plurality of conductors and the dielectric layer, or adjacent to the emissive layer. The at least one topological leveling layer may be comprised of a vinyl-based compound, a lacquer-based compound, or a nanoparticle carbon coating. The exemplary embodiment may also include a plurality of topological leveling layers, with a first topological leveling layer of the plurality of topological leveling layers comprised of a vinyl-based compound and with a second topological leveling layer of the plurality of topological leveling layers comprised of a lacquer-based compound. In exemplary embodiments, the least one topological leveling layer provides for a surface of the emissive display having a topological variation not greater than about four microns.

In exemplary embodiments, a first conductor of the first plurality of conductors is spaced apart from a second conductor of the first plurality of conductors by a substantially uniform and predetermined distance. In addition, the first conductor of the first plurality of conductors may further comprise a conductor disposed in a grid pattern. Also, the first plurality of conductors may be spaced apart and disposed substantially parallel in a first orientation, and exemplary embodiments may further comprise a second plurality of transmissive conductors, with the second plurality of transmissive conductors spaced apart and disposed substantially parallel in a second, different orientation.

The exemplary embodiment may also include a third conductor coupled to the second, optically transmissive conductor, with the third conductor having an impedance comparatively lower than an impedance of the second, optically transmissive conductor. The third conductor may comprise at least one conductive path and is formed from a conductive ink or a conductive polymer.

The exemplary embodiment may also include a second sealing layer coupled to the second, optically transmissive conductor; and a color layer coupled to the second sealing layer or to the second, optically transmissive conductor. The color layer may comprise at least one fluorescent colorant or color conversion material.

In exemplary embodiments, the substrate may have a thickness between about one mil and fifteen mils. The second, optically transmissive conductor may comprises antimony tin oxide, indium tin oxide, or polyethylene-dioxithiophene. Also in exemplary embodiments, the emissive display has a substantially flat form factor and has a depth less than five millimeters, or may have width and length providing a display area greater than one-half meter squared and also a depth less than five millimeters.

"Reverse-build" embodiments are also discussed, in which successive layers are applied in a reverse order to a clear or otherwise optically transmissive substrate. In another exemplary embodiment of the invention, an emissive display comprises: an optically transmissive substrate; at least one color layer coupled to the optically transmissive substrate; a first, transmissive conductor coupled to the at least one color layer; an emissive layer coupled to the first, transmissive conductor; a dielectric layer coupled to the emissive layer; a second plurality of conductors coupled to the dielectric layer, and wherein a first conductor of the second plurality of conductors is coupled to the first, transmissive conductor; and a first sealing layer coupled to the second conductor.

In another exemplary embodiment of the invention, an emissive display comprises: a substrate; a first sealing layer coupled to the substrate; a first conductive layer coupled to the sealing layer, the first conductive layer comprising a first plurality of electrodes and a second plurality of electrodes, the second plurality of electrodes electrically isolated from the first plurality of electrodes; a dielectric layer coupled to the first conductive layer; an emissive layer coupled to the dielectric layer; a plurality of transmissive conductors coupled to the emissive layer and correspondingly coupled to the second plurality of electrodes; and a second sealing layer coupled to the plurality of transmissive conductors.

In another exemplary embodiment of the invention, method of fabricating an emissive display is provided. The exemplary method comprises: printing a first conductive layer, in a first selected pattern, on a substrate having a hydrophobic surface; printing a dielectric layer over the first conductive layer; printing an emissive layer over the dielectric layer; printing a second, transmissive conductive layer, in a second selected pattern, over the emissive layer; printing at least one topological leveling layer; and printing a sealing layer over the second, transmissive conductive layer. The exemplary method may further include printing a third conductive layer over the second transmissive conductive layer, wherein the third conductive layer has a comparatively lower impedance than the second transmissive conductive layer.

Numerous other advantages and features of the present invention will become readily apparent from the following detailed description of the invention and the embodiments thereof, from the claims and from the accompanying drawings.

BRIEF DESCRIPTION OF THE DRAWINGS

The objects, features and advantages of the present invention will be more readily appreciated upon reference to the following disclosure when considered in conjunction with the accompanying drawings, wherein like reference numerals are used to identify identical components in the various diagrams, in which.

DETAILED DESCRIPTION OF EXEMPLARY EMBODIMENTS

Figure 1:
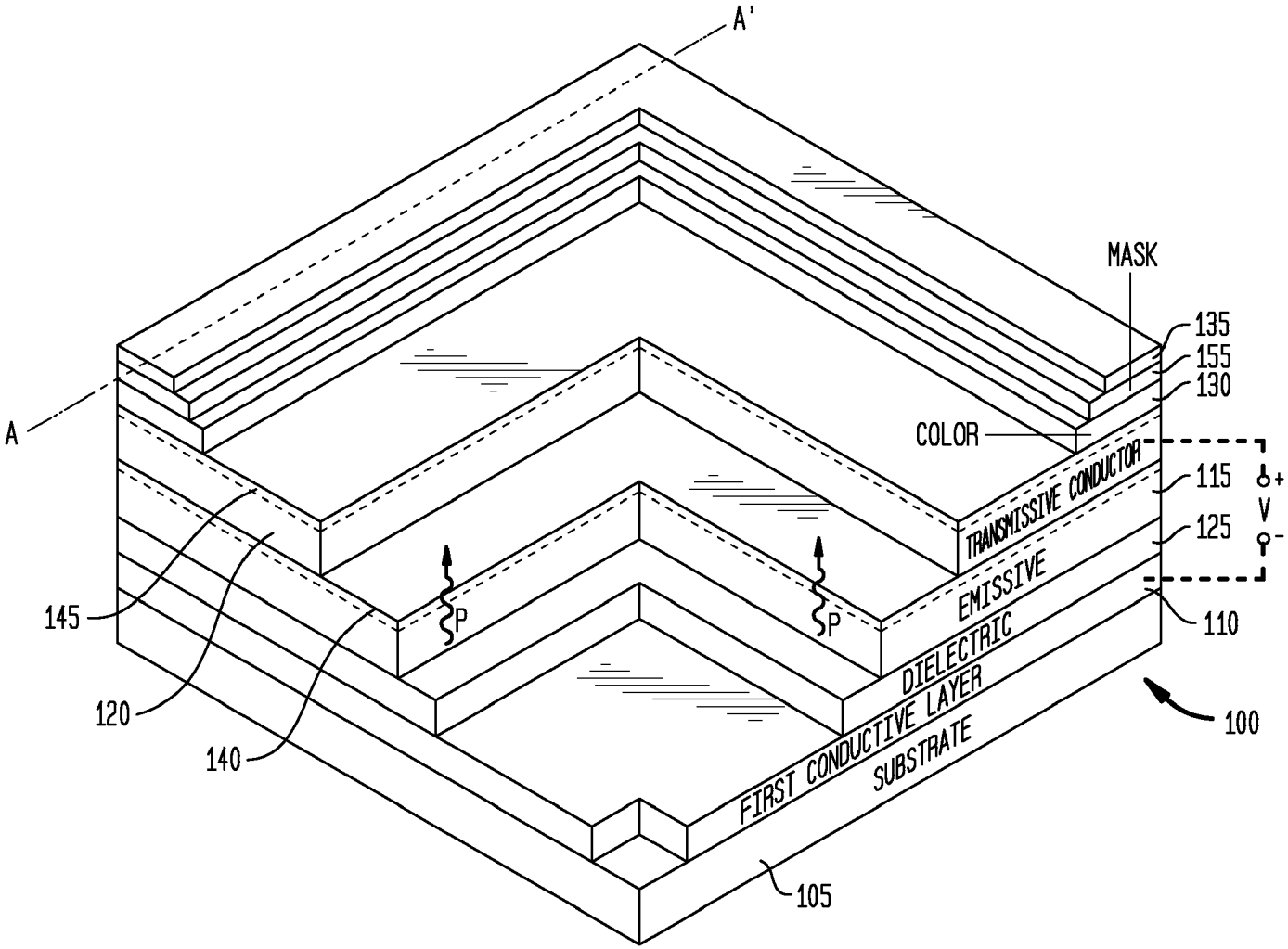
FIG. 1 is a perspective view of a first exemplary apparatus embodiment 100 in accordance with the teachings of the present invention.

While the present invention is susceptible of embodiment in many different forms, there are shown in the drawings and will be described herein in detail specific exemplary embodiments thereof, with the understanding that the present disclosure is to be considered as an exemplification of the principles of the invention and is not intended to limit the invention to the specific embodiments illustrated. In this respect, before explaining at least one embodiment consistent with the present invention in detail, it is to be understood that the invention is not limited in its application to the details of construction and to the arrangements of components set forth above and below, illustrated in the drawings, or as described in the examples. Methods and apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

As mentioned above, the various exemplary embodiments of the present invention provide addressable emissive displays. The various embodiments of the invention may be formed by any of a plurality of printing or coating processes. The invention may be embodied using comparatively inexpensive materials, such as paper and phosphors, substantially reducing production costs and expenses. The various embodiments are scalable, virtually limitlessly, while having a substantially flat form factor. In addition, the various embodiments provide a wide range of selectable resolutions and are highly and unusually robust under a wide variety of applications and environmental conditions.

Referring now to the drawings, FIGS. 1-20 illustrate various exemplary embodiments of the present invention. It should be noted that the various FIGS. 1-16 and 18-20 provide highly magnified views of representative portions or sections of the various exemplary apparatus and system embodiments, and are not to scale, for ease of reference. It should also be noted that implementations of the exemplary embodiments are generally quite flat and thin, having a thickness (depth) on the order of several sheets of fine paper (e.g., 130 μm), with any selected width and length, such as poster size and billboard size, to smaller scales, such as the size of computer display screens and mobile telephone display screens.

Figure 2:
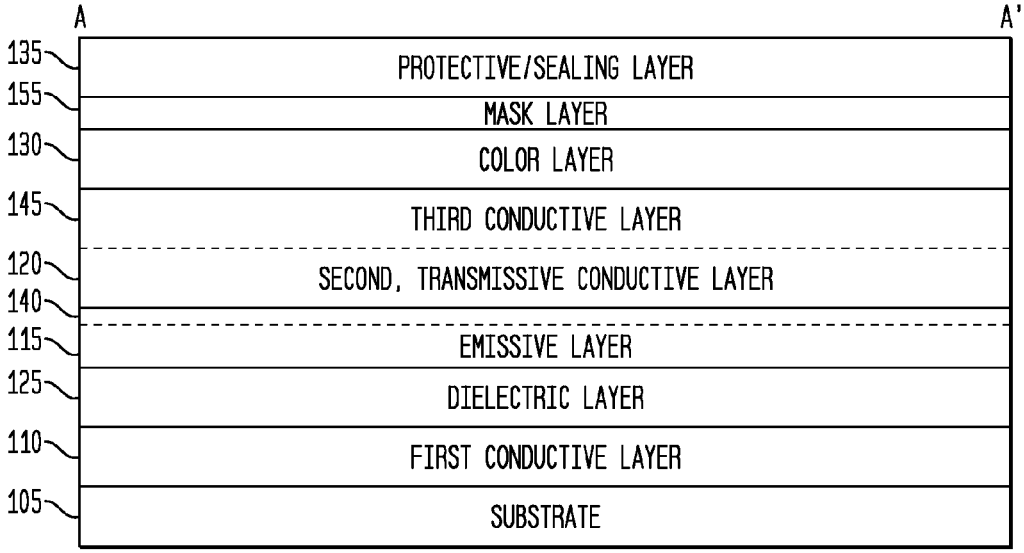
FIG. 2 is a cross-sectional view of the first exemplary apparatus embodiment in accordance with the teachings of the present invention.

FIG. 1 is a perspective view of a first exemplary apparatus embodiment 100 in accordance with the teachings of the present invention. FIG. 2 is a cross-sectional view of the first exemplary apparatus embodiment 100 in accordance with the teachings of the present invention, from the plane A-A' illustrated in FIG. 1. Apparatus 100 comprises a plurality of layers, with each layer adjacent the next as illustrated, including a substrate layer 105, a first conductive layer 110, an emissive (visible light emitting) layer 115, and a second, transmissive conductive layer 120. Depending on the selected embodiment, the apparatus 100 also generally includes one or more of the following layers: a first dielectric layer 125, a second dielectric layer 140 (which may be part of or integrated with the first dielectric layer 125 or emissive layer 115), a third conductive layer 145 (which may be part of or integrated with the second transmissive conductive layer 120), a color layer 130, a mask layer 155, and a protective or sealing layer 135. (Additional sealing (encapsulating) and topological leveling layers are illustrated and discussed below with reference to FIGS. 18 and 20.)

In operation, and as explained in greater detail below, a voltage difference is applied between or across: (1) the third conductive layer 145 with the second transmissive conductive layer 120, and (2) the first conductive layer 110, thereby providing energy to the emissive layer 115, such as by creating a capacitive effect. The energy or power supplied to the emissive layer 115 causes incorporated light-emitting compounds, discussed below, to emit visible light (e.g., as photons, illustrated as "p" in FIG. 1). The second transmissive conductive layer 120 allows the visible light generated in the emissive layer 115 to pass through, allowing visibility of the emitted light to any observer located on the display side (i.e., the transmissive conductive layer 120 side) of the apparatus 100. As discussed in greater detail below, the third conductive layer 145 may be formed from an opaque conductor, but is configured to allow significant light transmission, while at the same time, dramatically increasing the conductivity of the second transmissive conductive layer 120. As a consequence, apparatus 100 is adapted to operate and is capable of operating as a light emitting display.

Most extraordinary, the apparatus 100 may be produced to be very flat, with minimal thickness, having a depth on the order of a few sheets of paper. Indeed, the substrate layer 105 may be comprised of a single sheet of paper, for example, with all the remaining layers applied in succession with varying thicknesses through conventional printing and/or coating processes known to those of skill in the printing and coating arts. For example, working prototypes have been created using a wide variety of printing and coating processes. As a consequence, as used herein, "printing" means, refers to and includes any and all printing, coating, rolling, spraying, layering, sputtering, deposition, lamination and/or affixing processes, whether impact or non-impact, currently known or developed in the future, including without limitation screen printing, inkjet printing, electro-optical printing, electroink printing, photoresist and other resist printing, thermal printing, laser jet printing, magnetic printing, pad printing, flexographic printing, hybrid offset lithography, Gravure and other intaglio printing. All such processes are considered printing processes herein, may be utilized equivalently, and are within the scope of the present invention. In exemplary embodiments, electroluminescent displays have been printed on paper-based substrates as thin about one mil (one one-thousandths of an inch 0.0254 mm) (or slightly less than about one mil) to fifteen mils.

Also significant, the exemplary printing processes do not require significant manufacturing controls or restrictions. No specific temperatures or pressures are required. No clean room or filtered air is required beyond the standards of known printing processes. For consistency, however, such as for proper alignment (registration) of the various successively applied layers forming the various embodiments, relatively constant temperature (with a possible exception, discussed below) and humidity may be desirable. In addition, the various compounds utilized may be contained within various polymers, binders or other dispersion agents which may be heat-cured or dried, air dried under ambient conditions, or uv cured, for example, and all such variations are within the scope of the present invention.

A substrate (layer) 105 (and the other substrate (layers) 205, 305, 405 and 505 of the other exemplary embodiments discussed below) may be formed from virtually any material, with the suitability of any selected material determined empirically. A substrate layer 105, 205, 305, 405 and 505, without limitation of the generality of the foregoing, may comprise one or more of the following, as examples: paper, coated paper, plastic coated paper, fiber paper, cardboard, poster paper, poster board, books, magazines, newspapers, wooden boards, plywood, and other paper or wood-based products in any selected form; plastic materials in any selected form (sheets, film, boards, and so on); natural and synthetic rubber materials and products in any selected form; natural and synthetic fabrics in any selected form; glass, ceramic, and other silicon or silica-derived materials and products, in any selected form; concrete (cured), stone, and other building materials and products; or any other product, currently existing or created in the future. In a first exemplary embodiment, a substrate (105) may be selected which provides a degree of electrical insulation (i.e., has a dielectric constant or insulating properties sufficient to provide electrical isolation of the first conductive layer 110 on that (second) side of the apparatus 100). For example, while a comparatively expensive choice, a silicon wafer also could be utilized as a substrate 105. In other exemplary embodiments, however, a plastic-coated paper product is utilized to form the substrate layer 105, such as the patent stock and 100 lb. cover stock available from Sappi, Ltd., or similar coated papers from other paper manufacturers such as Mitsubishi Paper Mills, Mead, and other paper products. In additional exemplary embodiments, any type of substrate 105 may be utilized, with additional sealing or encapsulating layers applied to a surface of the substrate 105, as illustrated with respect to FIGS. 18-20. For example, depending upon the selected substrate 105, the various first sealing layers (such as lacquer and vinyl) which would otherwise coat the substrate 105 may be unnecessary for encapsulation and eliminated.

There are primarily two types of methods of constructing the various emissive displays (100, 200, 300, 500, 600, 700, 900) of the present invention. In a first build-type or "standard build", successive layers are applied to an opaque or non-transmissive substrate 105 (with or without one or more sealing layer(s)), with light being emitted through the top layer of the standard build. In other embodiments referred to as a second build-type or "reverse build", successive layers are applied in reverse order to a clear or otherwise optically transmissive substrate 105, with light being emitted through the substrate layer of the reverse build. For example, polyvinyl chloride or other polymers may be utilized as substrates for a "reverse build", with a clear substrate forming a top layer, and all remaining layers applied in a reverse order, such that the first conductive layer (e.g., 110) is applied last or next to last (followed by a protective coating). Such reverse build embodiments allow for attachment using the transmissive side of the apparatus, such as to attach to a window and view the display through the window.

The first conductive layer 110 may then be printed or coated, in any selected configuration or design, onto the substrate 105, forming one or more electrodes utilized to provide energy or power to one or more selected portions of the emissive layer 115 (such as the entire area of the emissive layer 115 or selected pixels within the emissive layer 115). The first conductive layer 110 may be created in any selected shape to have corresponding illumination, such as in a plurality of separate, electrically isolated strips (e.g., as in the second through fifth embodiments discussed below), to provide row or column selection, for discrete pixel illumination, or as a plurality of small dots for individual pixel selection, or as one or more sheets or sections, to provide illumination of one or more sections of the emissive layer 115, as in FIG. 1. For example, a plurality of first conductive layers 110 may be created to illuminate different sections of the display independently of each other, such as in any selected sequence or pattern. The thickness (or depth) of the first conductive layer 110 is not particularly sensitive or significant and may be empirically determined based upon the selected material and application process, requiring only sufficient thickness to conduct electricity and not have open circuits or other unwanted conduction gaps, while concomitantly maintaining the desired aspect ratio or thickness of the finished apparatus 100.

In the selected embodiments, the first conductive layer 110 (and the other first conductive layers 210, 310, 410 and 510 of the other exemplary embodiments discussed below) is formed utilizing a conductive ink, such as a silver (Ag) ink. Such a conductive ink is applied to the substrate 105 via one or the printing processes discussed above, creating the first conductive layer 110. Other conductive inks or materials may also be utilized to form the first conductive layer 110, such as copper, tin, aluminum, gold, noble metals or carbon inks, gels or other liquid or semi-solid materials. In addition, any other printable or coatable conductive substances may be utilized equivalently to form the first conductive layer 110, and exemplary conductive compounds include: (1) From Conductive Compounds (Londonberry, N.H., USA), AG-500, AG-800 and AG-510 Silver conductive inks, which may also include an additional coating UV-1006S ultraviolet curable dielectric (such as part of a first dielectric layer 125); (2) From DuPont, 7102 Carbon Conductor (if overprinting 5000 Ag), 7105 Carbon Conductor, 5000 Silver Conductor (also for bus 710, 715 of FIG. 16 and any terminations), 7144 Carbon Conductor (with UV Encapsulants), 7152 Carbon Conductor (with 7165 Encapsulant), and 9145 Silver Conductor (also for bus 710, 715 of FIG. 16 and any terminations); (3) From SunPoly, Inc., 128A Silver conductive ink, 129A Silver and Carbon Conductive Ink, 140A Conductive Ink, and 150A Silver Conductive Ink; and (4) From Dow Corning, Inc., PI-2000 Series Highly Conductive Silver Ink. As discussed below, these compounds may also be utilized to form third conductive layer 145. In addition, conductive inks and compounds may be available from a wide variety of other sources.

Conductive polymers may also be utilized to form the first conductive layer 110 (and the other first conductive layers 210, 310, 410 and 510 of the other exemplary embodiments discussed below), and also the third conductive layer 145. For example, polyethylene-dioxithiophene may be utilized, such as the polyethylene-dioxithiophene commercially available under the trade name "Orgacon" from Agfa Corp. of Ridgefield Park, N.J., USA. Other conductive polymers, without limitation, which may be utilized equivalently include polyaniline and polypyrrole polymers, for example.

In another exemplary embodiment, an embossed substrate 105 is utilized, such that the substrate 105 has an alternating series of ridges forming (smooth) peaks and valleys, generally all having a substantially parallel orientation. Conductive inks or polymers may then be applied to remain in either the embossed peaks or valleys, and preferably not to remain in both the peaks and valleys for addressable displays, creating a first plurality of conductors (in the first conductive layer 110) which are not only substantially parallel, but which also have a physical separation from each other determined by the embossing. Indeed, when the conductive inks or polymers are applied to the embossed valleys, the corresponding first plurality of conductors are also separated from each other by the embossed peaks, creating a physical separation in addition to being spaced apart. For example, conductive inks or polymers may be applied to an embossed substrate in its entirety, and then utilizing a "doctor blade", the conductive inks or polymers are removed from all of the peaks, leaving the conductive inks or polymers to form a first plurality of conductors having a substantially parallel orientation. Alternatively, conductive inks or polymers may be applied (using negligible or zero pressure) to the embossed peaks only, also leaving the conductive inks or polymers to form a first plurality of conductors having a substantially parallel orientation.

After the conductive ink, polymer or other substance has dried or cured on the substrate 105, depending upon the selected embodiment, these two layers may be calendarized as known in the printing arts, in which pressure and heat are applied to these two layers 105 and 110, tending to provide an annealing affect on the first conductive layer 110 for improved conduction capabilities. In the other exemplary embodiments discussed below, the other first conductive layers 210, 310, 410 and 510 may be created identically to the first conductive layer 110. The resulting thickness of the first conductive layer 110 is generally in the range of 1-2 microns. In other exemplary embodiments, such as those illustrated in FIGS. 18-20, or in the method utilizing the embossed substrate discussed above, no such calendarizing is utilized.

If the first conductive layer 110 is provided in one or more parts or portions, then the apparatus 100 (as it is being formed) should be properly aligned or registered, to provide that the conductive inks are printed to the desired or selected level of precision or resolution, depending on the selected embodiment. For example, in the fourth exemplary embodiment discussed below, the corresponding first conductive layer 410 is utilized to create multiple, electrically isolated electrodes (cathodes and anodes), which may be formed during one printing cycle; if created in more than one cycle, the substrate 105 and the additional layers should be correspondingly and properly aligned, to provide that these additional layers are placed correctly in their selected locations. Similarly, as additional layers are applied to create the apparatus 100 (200, 300, 400 or 500), such as the transmissive conductive layer 120 and the third conductive layer 145, such proper alignment and registration are also important, to provide for proper pixel selection using corresponding pixel addressing, as may be necessary or desirable for a selected application.

The first dielectric layer 125 may be coated or printed over the first conductive layer 110, with the emissive layer 115 coated or printed over the dielectric layer 125. As illustrated in FIGS. 1 and 2, the dielectric layer 125 is utilized to provide additional smoothness and/or affect the dielectric constant of the emissive layer 115. For example, in the selected exemplary apparatus embodiment 100, one or more coatings of barium titanate ($BaTiO_3$) and/or titanium dioxide is utilized, both to provide for smoothness for printing of additional layers, and to adjust the dielectric constant of the electroluminescent compound in the emissive layer 115. For such an exemplary embodiment, 1-2 printing coats or layers of barium titanate and/or titanium dioxide are applied, with each coating being substantially in the 6 micron range for barium titanate and for titanium dioxide, approximately, to provide an approximately 10-12 micron dielectric layer 125, with a 12 micron dielectric layer 125 utilized in the various exemplary embodiments. For example, the first dielectric layer 125 may be applied to completely coat an embossed substrate 105 having the first plurality of conductors, creating a substantially smooth surface for the printing or deposition of succeeding layers. In addition, optionally, a second dielectric layer 140 (formed of the same materials as layer 125) may also be included as part of the emissive layer 115, or applied as an additional layer.

In contrast with the prior art, and as discussed below with reference to FIGS. 18-20, at any stage of layer printing or other deposition, additional, topological leveling or filler layers may also be applied to create a comparatively smooth surface, substantially free of topological variation to a selected tolerance level. For example, prior to adding a first dielectric layer 125, leveling layers may be applied to the areas which are not covered by the first conductive layer 110. In an exemplary embodiment (discussed below with reference to FIGS. 18-20), a leveling layer is utilized which also provides for a visually neutral density; for example, when a conductive ink having a gray appearance forms the first conductive layer 110, a gray lacquer is utilized, to provide for both sealing and a visually neutral appearance. In addition, such leveling layers are utilized to create a more uniformly smooth surface, such as to support additional printing of one or more colors using printing technologies which are comparatively more sensitive to surface topology, depth variations or otherwise require a substantially smooth surface having negligible or minimal surface depth variation (e.g., up to a four micron surface depth variation for non-screen printing technologies, such as Intaglio or Gravure).

Such topological leveling is new and novel, and also allows for direct integration of the electroluminescent display with artwork or designs, especially more complex artwork and designs which may be utilized for posters, displays, marketing materials, etc., as opposed to the merely lettered signage of the prior art. For example, a plurality of electroluminescent regions having a comparatively smooth surface may be formed directly as part of an integrated, high resolution design applied using a Gravure or Intaglio press. Given the significant topological variations of prior art static electroluminescent displays, such direct application of designs and artwork using such high-resolution printing technology was unavailable. Rather, such prior art static electroluminescent displays would have required separate lamination of a preprinted design over the finished electroluminescent device. A wide variety of dielectric compounds may be utilized to form the various dielectric layers, and all are within the scope of the present invention, and which may be included within heat- or uv-curable binders, for example. Exemplary dielectric compounds utilized to form the dielectric layers include, without limitation: (1) From Conductive Compounds, a barium titanate dielectric; (2) From DuPont, 5018A Clear UV Cure Ink, 5018G Green UV Cure Ink, 5018 Blue UV Cure Ink, 7153 High K Dielectric Insulator, and 8153 High K Dielectric Insulator; (3) From SunPoly, Inc., 305D UV Curable dielectric ink and 308D UV Curable dielectric ink; and (4) from various supplies, Titanium Dioxide-filled UV curable inks The emissive layer 115 is then applied, such as through printing or coating processes discussed above, over the first dielectric layer 125. The emissive layer 115 may be formed of any substance or compound capable of or adapted to emit light in the visible spectrum (or other electromagnetic radiation at any selected frequency) in response to an applied electrical field, such as in response to a voltage difference supplied to the first conductive layer 110 and the transmissive conductive layer 120. Such electroluminescent compounds include various phosphors, which may be provided in any of various forms and with any of various dopants, such as a zinc sulfide or a cadmium sulfide doped with copper, magnesium, strontium, cesium, rare earths, etc. One such exemplary phosphor is a zinc sulfide (ZnS-doped) phosphor, which may be provided in an encapsulated form for ease of use, such as the micro-encapsulated ZnS-doped phosphor encapsulated powder from the DuPont™ Luxprint® electroluminescent polymer thick film materials. This phosphor may also be combined with a dielectric such as barium titanate or titanium dioxide, to adjust the dielectric constant of this layer, may be utilized in a polymer form having various binders, and also may be separately combined with various binders (such as phosphor binders available from DuPont or Conductive Compounds), both to aid the printing or other deposition process, and to provide adhesion of the phosphor to the underlying and subsequent overlying layers. The emissive layer 115 may also be provided in either uv-curable or heat-curable forms.

A wide variety of equivalent electroluminescent compounds are available and are within the scope of the present invention, including without limitation: (1) From DuPont, 7138J White Phosphor, 7151J Green-Blue Phosphor, 7154J Yellow-Green Phosphor, 8150 White Phosphor, 8152 Blue-Green Phosphor, 8154 Yellow-Green Phosphor, 8164 High-Brightness Yellow-Green and (2) From Osram, the Glacier-Glo series, including blue GGS60, GGL61, GGS62, GG65; blue-green GGS20, GGL21, GGS22, GG23/24, GG25; green GGS40, GGL41, GGS42, GG43/44, GG45; orange type GGS10, GGL11, GGS12, GG13/14; and white GGS70, GGL71, GGS72, GG73/74.

When the selected micro-encapsulated ZnS-doped phosphor encapsulated powder electroluminescent material is utilized to form the emissive layer 115, the layer should be formed to be approximately 20-45 microns thick (12 microns minimum), or to another thickness which may be determined empirically when other electroluminescent compounds are utilized. When other phosphors or electroluminescent compounds are utilized, the corresponding thickness should be empirically determined to provide sufficient thickness for no dielectric breakdown, and sufficient thinness to provide comparatively high capacitance. Again, as in the creation or development of the other layers forming the various exemplary embodiments, such as apparatus 100, the emissive layer 115 may be applied using any printing or coating process, such as those discussed above. As mentioned above, the emissive layer 115 may also incorporate other compounds to adjust the dielectric constant and/or to provide binding, such as the various dielectric compounds discussed above.

In the other exemplary embodiments discussed below, the other emissive layers 215, 315, 415 and 515 may be created identically to the emissive layer 115. In addition, an additional layer can be and generally is included between the corresponding emissive layer and the corresponding overlaying transmissive conductive layer, such as a coating layer to provide additional smoothness and/or affect the dielectric constant of the emissive layer. For example, in some of the various exemplary embodiments, a coating of barium titanate ($BaTiO_3$), titanium dioxide ($TiO_2$), or a mixture of barium titanate and titanium dioxide, is utilized, both to provide for smoothness for printing of additional layers, and to reduce the dielectric constant of the selected electroluminescent compound from about 1500 to closer to 10. For such an exemplary embodiment, 2-3 printing coats or layers of barium titanate and/or titanium dioxide are applied, with each coating being substantially in the 6 micron range for barium titanate and for titanium dioxide, approximately.

In addition, depending upon the selected embodiment, colorants, dyes and/or dopants may be included within any such emissive layer. In addition, the phosphors or phosphor capsules utilized to form an emissive layer may include dopants which emit in a particular spectrum, such as green or blue. In those cases, the emissive layer may be printed to define pixels for any given or selected color, such as RGB or CMY, to provide a color display.

In another exemplary embodiment, one or more color layers are provided independently of or decoupled from the emissive layer 115, either forming separate pixels in one or more color layer(s) 130, or forming an image to be illuminated, such as a four, six or eight color image, for example.

Following application of the emissive layer 115 (and any other additional layers discussed below), the second, transmissive conductive layer 120 is applied, such as through printing or coating processes discussed above, over the emissive layer 115 (and any additional layers). The second, transmissive conductive layer 120, and the other transmissive conductive layers (220, 320, 420 and 520) of the other exemplary embodiments, may be comprised of any compound which: (1) has sufficient conductivity to energize selected portions of the apparatus in a predetermined or selected period of time; and (2) has at least a predetermined or selected level of transparency or transmissibility for the selected wavelength(s) of electromagnetic radiation, such as for portions of the visible spectrum. For example, when the present invention is utilized for a static display having a comparatively smaller form factor, the conductivity time or speed in which the transmissive conductive layer 120 provides energy across the display to energize the emissive layer 115 is comparatively less significant than for other applications, such as for active displays of time-varying information (e.g., computer displays) or for static displays having a comparatively larger form factor. As a consequence, the choice of materials to form the second, transmissive conductive layer 120 may differ, depending on the selected application of the apparatus 100, and depending upon the utilization of a third conductive layer (discussed below).

As discussed above, this transmissive conductive layer 120 (and the other transmissive conductive layers 220, 320, 420 and 520) is applied to the previous layer of the corresponding embodiment using a conventional printing or coating process, with proper control provided for any selected alignment or registration. For example, in the various exemplary embodiments discussed below, a transmissive conductive layer is utilized to create multiple, electrically isolated electrodes (individual transparent wires or dots), which may be formed during one or more printing cycles, and which should be properly aligned in comparison with the electrodes of the first conductive layer 110, to provide for proper pixel selection using corresponding pixel addressing, as may be necessary or desirable for a selected application. In other applications, such as for static displays or signage, in which the transmissive conductive layer 120 may be a unitary sheet, for example, such alignment issues are comparatively less significant.

In the exemplary embodiment of apparatus 100, polyethylene-dioxithiophene (e.g., Orgacon), a polyaniline or polypyrrole polymer, indium tin oxide (ITO) and/or antimony tin oxide (ATO) is utilized to form the second, transmissive conductive layer 120 (and the other transmissive conductive layers 220, 320, 420 and 520 of the other exemplary embodiments). While ITO or ATO provides sufficient transparency for visible light, its impedance or resistance is comparatively high (e.g., 20 kΩ), generating a correspondingly comparatively high (i.e., slow) time constant for electrical transmission across this layer of the apparatus 100, such as down a corresponding electrode. Other compounds having comparatively less impedance may also be utilized, such as polyethylene-dioxithiophene. As a consequence, in some of the exemplary embodiments, a third conductor (third conductive layer 145) having a comparatively lower impedance or resistance is or may be incorporated into this second, transmissive conductive layer 120 (and the other transmissive conductive layers (220, 320, 420 and 520 of the other exemplary embodiments), to reduce the overall impedance or resistance of this layer, decrease conduction time, and also increase the responsiveness of the apparatus to changing information for dynamic displays (see, e.g., FIG. 12). As indicated above, for static displays having larger form factors, such a third conductive layer 145 may be utilized to provide more rapid illumination, enabling the energizing of the more central portions of the area to be illuminated, which would otherwise remain non-energized and dark, due to the insufficient conduction of many types of compounds which may be selected for use in a second, transmissive conductive layer 120. This is also significant for illumination in various patterns for larger displays, such as for rapid blinking or sequential illumination of different display regions. For example, to form a third conductive layer 145, one or more fine wires may be formed using a conductive ink or polymer (e.g., a silver ink or a polyethylene-dioxithiophene polymer) printed over corresponding strips or wires of the second, transmissive conductive layer 120, or one or more fine wires (e.g., having a grid pattern) may be formed using a conductive ink or polymer printed over a larger, unitary second, transmissive conductive layer 120 in larger displays, to provide for increased conduction speed throughout the second, transmissive conductive layer 120.

In an exemplary addressable display embodiment, the third conductive layer 145 is formed as a series of fine wires using a conductive ink, with one wire disposed centrally in the longitudinal axis of each second conductor of the plurality of second conductors of transmissive conductive layer 120, and having a width comparable to the separation between each of the second conductors of the plurality of second conductors of transmissive conductive layer 120. In this embodiment, an illuminated region may have a visual appearance of two illuminated pixels, depending upon the selected resolution.

Other compounds which may be utilized equivalently to form the transmissive conductive layer 120 (220, 320, 420, 520) include indium tin oxide (ITO) as mentioned above, and other transmissive conductors as are currently known or may become known in the art, including one or more of the conductive polymers discussed above, such as polyethylene-dioxithiophene available under the trade name "Orgacon". Representative transmissive conductive materials are available, for example, from DuPont, such as 7162 and 7164 ATO translucent conductor. The second, transmissive conductive layer 120 (and the other transmissive conductive layers 220, 320, 420 and 520) may also be combined with various binders, such as binders which are curable under various conditions, such as exposure to ultraviolet radiation (uv curable).

As mentioned above, in operation, a voltage difference is applied across (1) the second, transmissive conductive layer 120 (and/or the third conductive layer 145) and (2) the first conductive layer 110, thereby providing energy to the emissive layer 115, such as by creating a capacitive effect. The supplied voltage is in the form of alternating current (AC) in the exemplary embodiments, having a frequency range of approximately or substantially 400 Hz to 2.5 kHz, while other equivalent embodiments may be capable of using direct current. The supplied voltage is generally over 60 Volts, and may be higher (closer to 100 V) for lower AC frequencies. Current consumption is in the pico-Ampere range, however, resulting in overall low power consumption, especially when compared to other types of displays (e.g., active matrix LCD displays). The supplied voltage should correspond to the type of electroluminescent compounds used in the emissive layer 115, as they may have varying breakdown voltages and may emit light at voltages different from that specified above. The energy or power supplied to the emissive layer 115 causes (ballistic) electron motion within the incorporated electroluminescent compounds, which then emit visible light (e.g., as photons) at selected frequencies, depending upon the corresponding bandgap(s) of the particular or selected dopant(s) utilized within a selected electroluminescent compound. As the emitted light passes through the transmissive conductive layer 120 for corresponding visibility, the apparatus 100 is adapted to operate and is capable of operating as a light emitting display.

Following application of the second, transmissive conductive layer 120, additional coatings or layers may also be applied to the apparatus 100, in addition to a third conductive layer. As discussed in greater detail below, color layers, filters, and/or dyes may be applied, as one or more layers or as a plurality of pixels or subpixels, such as through the printing processes previously discussed. A calcium carbonate coating may also be applied, to increase display brightness. Other transparent or transmissive protective or sealant coatings may also be applied, such as an ultraviolet (uv) curable sealant coating. In other exemplary embodiments, sealing (encapsulating) and topological leveling layers are also applied, as discussed below with reference to FIGS. 18 and 20.

Also illustrated in FIGS. 1 and 2, a third conductive layer 145 may be incorporated within, coated or printed onto, or otherwise provided as the next layer on top of the transmissive conductive layer 120. As discussed above, such a third conductive layer may be fabricated using a conductive ink or polymer such as polyethylene-dioxithiophene, may have appreciably lower impedance, and may be printed as fine lines (forming corresponding fine wires) on top of the transmissive conductive layer 120, to provide for increased conduction speed within and across the transmissive conductive layer 120.

This use of a third conductive layer in the various inventive embodiments is significant and novel. Prior art EL displays have been incapable of displaying real time information, in part due to their structures which lack addressing capability, but also in part to the high impedance and low rate of conduction through the typical transmissive layer, particularly when ITO is utilized. Because of such high impedance and low conductivity, energy transmission through such a transmissive layer has a large time constant, such that a transmissive layer of the prior art cannot be energized sufficiently quickly to provide energy to the emissive layer and accommodate rapidly changing pixel selection and display of changing information, or to energize the central portion of larger displays (which are at increased distances from the electrodes supplying power to the second, transmissive conductive layer 120). The use of the third conductive layer 145 overcomes this difficulty with prior art displays, and with other novel features and structures of the invention, allows the various inventive embodiments to display changing information in real time. In addition, for static displays having larger form factors, such a third conductive layer 145 may be utilized to provide more rapid illumination, enabling the energizing of the more central portions of the area to be illuminated, as discussed above.

Following application of the second, transmissive conductive layer 120 and any third conductive layer 145, a color layer 130 is printed or coated, to provide corresponding coloration for the light emitted from the emissive layer 115. Such a color layer 130 may be comprised of one or more color dyes, color fluorescent dyes, color filters, in a unitary sheet, as a plurality of pixels or subpixels, such as through the printing processes previously discussed. In another exemplary embodiment discussed with reference to FIGS. 18-20, an intervening sealing layer (135) is applied over the second, transmissive conductive layer 120 and any third conductive layer 145, prior to any application of a color layer 130.

In selected embodiments, a plurality of fluorescent or other color conversion materials, inks, dyes, pigments or other colorants are utilized to provide the color layer (e.g., color layer 130, 230, 330, 530, 630), resulting in several important features and advantages of the present invention. First, the use of fluorescent or other color conversion materials or colorants provides for a greater perceived light output, and possibly less actual photon absorption and higher actual light (lumen) output per watt. This is a significant advantage because, for the same input power, the various embodiments provide significantly greater illumination compared to prior art displays, even visible in daylight. In addition, this greater brightness concomitantly allows for increased resolution, as perceived by an observer. Moreover, the use of fluorescent colorants or other color conversion materials provides subtractive or additive coloration (e.g., CMYK or RGB coloration), and also retains white emission, also serving to potentially increase brightness.

Following application of the color layer 130, one or more additional protective or sealing and/or topological leveling layers 135 are applied, such as a calcium carbonate coating, followed by other transparent or transmissive protective or sealant coatings, such as an ultraviolet (uv) curable sealant coating. Other compounds may also be utilized in one or more sealing and topological leveling layers 135, including lacquers (clear or gray lacquers, for example, illustrated as 135A and 136, respectively, in FIG. 20) and vinyls (e.g., white vinyl, illustrated as 135B in FIG. 20), for example and without limitation. Exemplary sealing and/or topological leveling layers 135 may also be utilized to provide neutral density matching and may be in lieu of any additional or optional masking layers (155), such as the prior art background layers utilized as top layers to mask all underlying, non-illuminated portions of the static display.

In the exemplary embodiments, the compounds or other materials forming the sealing and/or topological leveling layers 135 have been selected to have specific properties, namely, the encapsulation of the active portions of the display device for protection against environmental factors, and surface properties compatible or suitable for application of printing compounds, such as inks and other colorants. In exemplary embodiments, the sealing and/or topological leveling layers 135 are also selected to provide a uv barrier, such as to suppress any visual appearance of fluorescence. In addition, multiple sealing and/or topological leveling layers 135 may be utilized, which must further be compatible with and adhere to each other, without requiring additional processing such as lamination. A particular advantage of using a (white) vinyl as or as part of a sealing layer is its printability, providing a surface to which other compounds adhere more readily. Another advantage of the use of a sealant such as lacquer is its significant hydrophobic properties, which serves to encapsulate the other layers forming the display and provide protection from environmental degradation, such as due to typical humidity. In addition, as mentioned above, the various sealing layers 135 may also be utilized as leveling (or filling) layers, providing additional control over the topology of the display surface.

In another exemplary embodiment, the sealing and/or topological leveling layers 135 may utilize a nanoparticle carbon coating, in lieu of separate sealing and/or topological leveling layers 135 such as lacquer and vinyl. One such nanoparticle carbon coating is available under the name "Carbon Nanoparticle Coating" from Ecology Coating of Akron, Ohio, USA. Such a nanoparticle carbon coating is generally provided with a uv-curable binder, but also may be provided with a heat-cured binder.

Continuing to refer to FIGS. 1 and 2, another apparatus 100 embodiment variation is also available. In this alternative embodiment, an optional masking (or black-out layer) 155 is utilized, overlaying color layer 130, and applied before or after any protective or sealing layers 135. For this display embodiment, each of the underlying layers (substrate layer 105, the first conductive layer 110, dielectric layer 125, the emissive layer 115, any additional dielectric layer 140, second transmissive conductive layer 120, any third conductive layer 145, and color layer 130) is applied or provided as a unitary, complete sheet, extending substantially over the width and length of the apparatus 100 (with the exception of providing room or otherwise ensuring access points to energize the first conductive layer 110, the second transmissive conductive layer 120 and any third conductive layer 145). The color layer is applied with each red, green or blue ("RGB") (or an other color scheme, such as cyan, magenta, yellow, and black ("CMYK")) representing a subpixel (or pixel). This portion of the apparatus 100 variation may be mass produced, followed by customization or other individualization through the use of the masking layer 155.

Following application of the color layer 130, the masking layer 155 is applied in a pattern such that masking is applied over any subpixels or pixels which are not to be visible (i.e., are masked) in the resulting display, and in predetermined combinations to provide proper color resolution when perceived by an ordinary observer. For example, opaque (such as black) dots of varying sizes may be provided, such as through the printing processes discussed above, with proper registration or alignment with the underlying red/green/blue subpixels. With this masking layer 155 applied, only those non-masked pixels will be visible through the overlaying protective or sealing layers 135. Using this variation, a back-lit display is provided, which may be customized during later fabrication stages, rather than earlier in the process. In addition, such a color, back-lit display may also provide especially high resolution, typically higher than that provided by a color RGB or CMY display.

As a light emitting display, the various embodiments of the invention have highly unusual properties. First, they may be formed by any of a plurality of conventional and comparatively inexpensive printing or coating processes, rather than through the highly involved and expensive semiconductor fabrication techniques, such as those utilized to make LCD displays, plasma displays, or ACTFEL displays. For example, the present invention does not require clean rooms, epitaxial silicon wafer growth and processing, multiple mask layers, stepped photolithography, vacuum deposition, sputtering, ion implantation, or other complicated and expensive techniques employed in semiconductor device fabrication.

Second, the invention may be embodied using comparatively inexpensive materials, such as paper and phosphors, substantially reducing production costs and expenses. The ease of fabrication using printing processes, combined with reduced materials costs, may revolutionize display technologies and the industries which depend upon such displays, from computers to mobile telephones to financial exchanges.

Third, the various embodiments are scalable, virtually limitlessly. For example, the various embodiments may be scaled up to wallpaper, billboard or larger size, or down to cellular telephone or wristwatch display size.

Fourth, at the same time, the various embodiments have a substantially flat form factor, with the total display thickness in the range of 50-55 microns, plus the additional thickness of the selected substrate. For example, using 3 mill paper (approximately 75 microns thick), the thickness of the resulting display is on the order of 130 microns, providing one of, if not the, thinnest addressable displays to date.

Fifth, the various embodiments provide a wide range of selectable resolutions. For example, the printing processes discussed above can provide resolutions considerably greater than 220 dpi (dots per inch), which is the resolution of high density television (HDTV), and may provide higher resolutions with ongoing device development.

Sixth, as has been demonstrated with various prototypes, the various exemplary embodiments are highly and unusually robust. Prototypes have been folded, torn, and otherwise maltreated, while still retaining significant (if not all) functionality.

Numerous other significant advantages and features of the various embodiments of the invention will be apparent to those of skill in the art.

Figure 3:
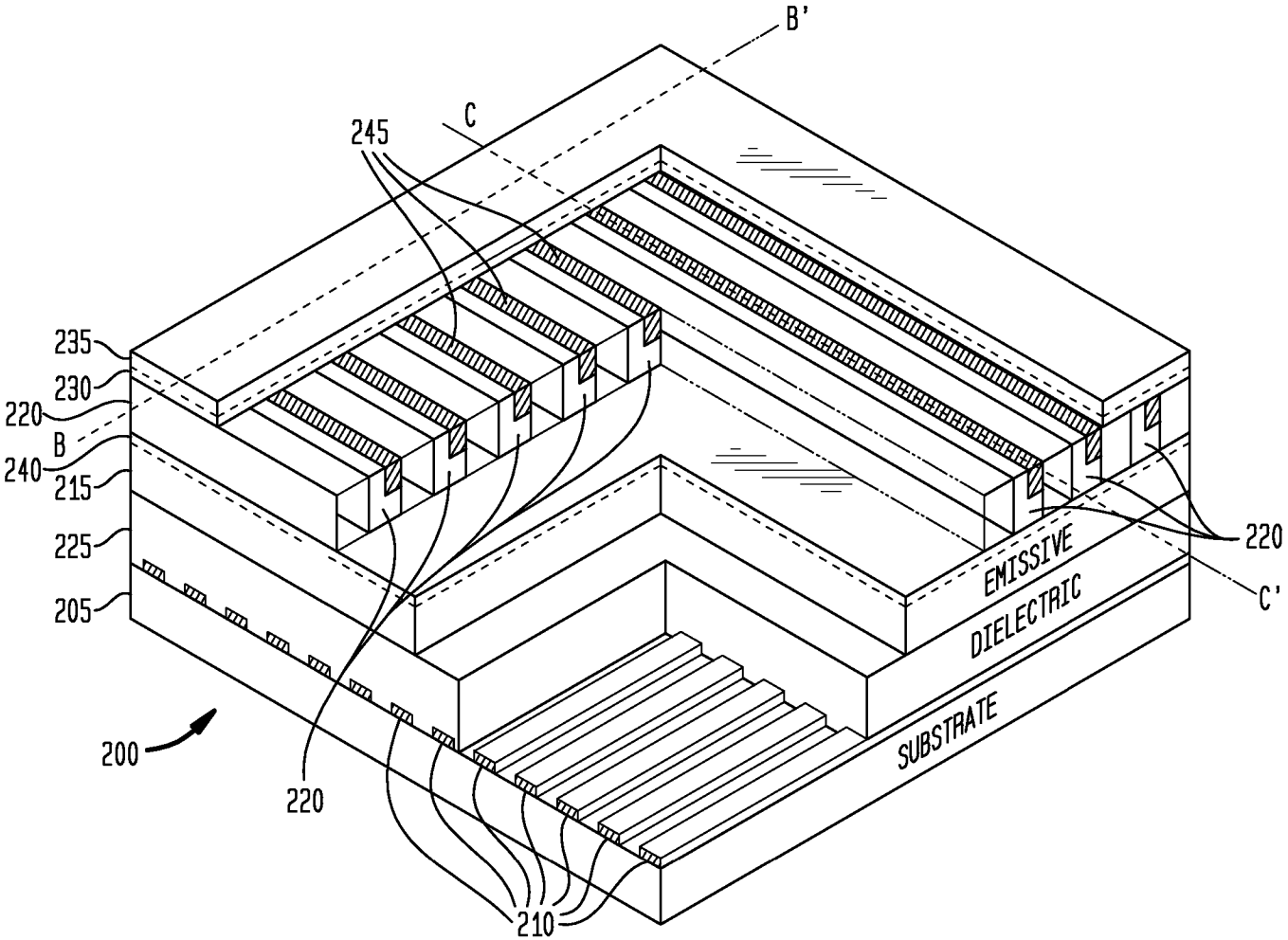
FIG. 3 is a perspective view of a second exemplary apparatus embodiment in accordance with the teachings of the present invention.
Figure 4:
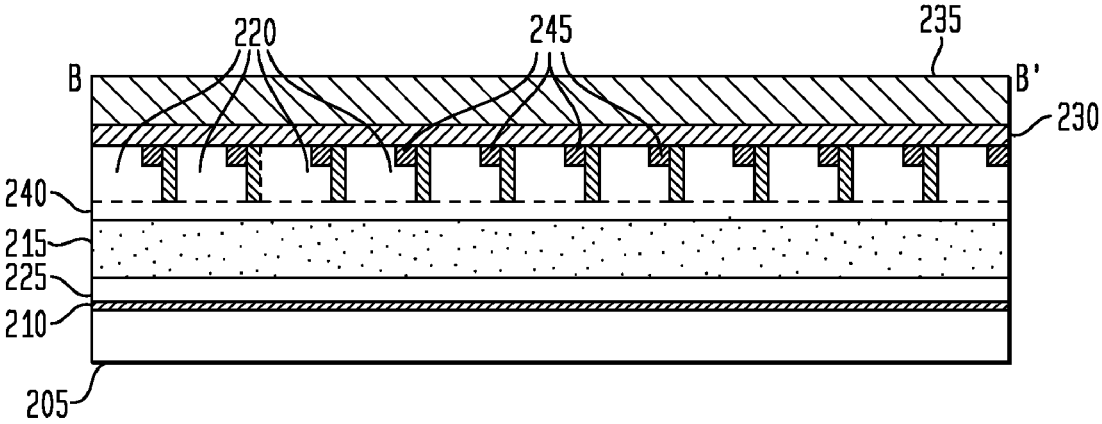
FIG. 4 is a cross-sectional view of the second exemplary apparatus embodiment in accordance with the teachings of the present invention.
Figure 5:
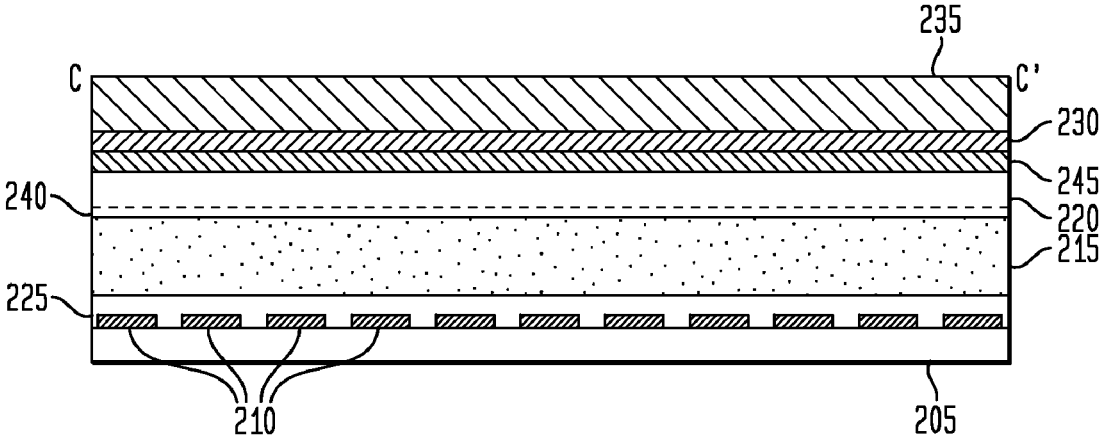
FIG. 5 is a cross-sectional view of the second exemplary apparatus embodiment in accordance with the teachings of the present invention.
Figure 6:
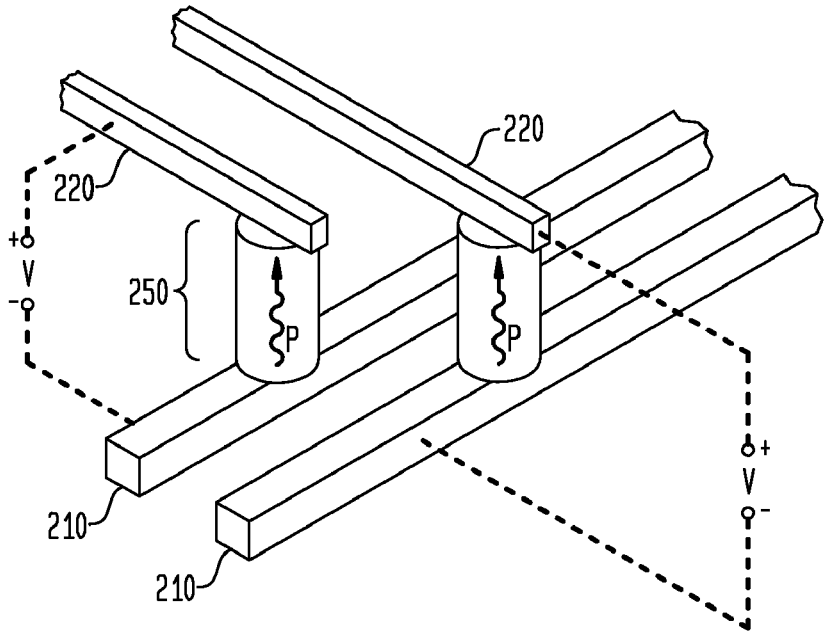
FIG. 6 is a perspective view of an emissive region (or pixel) of the second exemplary embodiment in accordance with the teachings of the present invention.

FIG. 3 is a perspective view of a second exemplary apparatus embodiment 300 in accordance with the teachings of the present invention. FIG. 4 is a cross-sectional view of the second exemplary apparatus embodiment 200 in accordance with the teachings of the present invention, through the B-B' plane of FIG. 3. FIG. 5 is a cross-sectional view of the second exemplary apparatus embodiment 200 in accordance with the teachings of the present invention, through the C-C' plane of FIG. 3. FIG. 6 is a perspective view of an exemplary emissive region (or pixel) of the second exemplary apparatus embodiment 200 in accordance with the teachings of the present invention. As discussed in greater detail below, the exemplary apparatus 200 is adapted to and capable of functioning as a dynamic display, with individually addressable light-emitting pixels, for the display of either static or time-varying information.

Referring to FIGS. 3-6, the apparatus 200 includes different structures for the first conductive layer 210, second transmissive conductive layer 220, and third conductive layer 245. The first conductive layer 210, second transmissive conductive layer 220, and third conductive layer 245 may be formed of the same materials as their respective counterparts previously discussed (the first conductive layer 110, second transmissive conductive layer 120, and third conductive layer 145). Also, the remaining layers of apparatus 200, namely, the substrate layer 205, the dielectric layers 225 and 240, the emissive layer 215, the color layer 230 (and any masking layer (not separately illustrated), sealing and/or topological leveling layers 135, and coating layer 235, may be formed of the same materials, may have the same configuration as, and may otherwise be identical to their respective counterparts (substrates 105, dielectric layers 125 and 140, emissive layer 115, color layer 130, sealing and/or topological leveling layers 135, and coating layer 135) previously discussed.

As illustrated in FIGS. 3-6, the first conductive layer 210 is formed as a first plurality of electrically isolated (or insulated) electrodes, such as in the form of strips or wires, which also may be spaced apart, all running in a first orientation or direction, such as parallel to the B-B' plane, (e.g., forming "rows"). The second transmissive conductive layer 220 is also formed as a second plurality of electrically isolated (or insulated) electrodes, such as in the form of transmissive strips or wires, which also may be spaced apart, all running in a second orientation or direction different than the first direction (e.g., forming "columns"), such as perpendicular to the B-B' plane (or, not illustrated, at any angle to the first direction sufficient to provide the selected resolution level for the apparatus 200). The third conductive layer 245 is also formed as a plurality of corresponding strips or wires, embedded or included within the second transmissive conductive layer 220, and is utilized to decrease conduction time through the second transmissive conductive layer 220. (An exemplary third conductive layer disposed within a second conductive layer is discussed below with reference to FIG. 10).

As illustrated in FIG. 6, when voltage difference is applied to a first electrode of the first plurality of electrodes from the first conductive layer 210 and a second electrode of the second plurality of electrodes from the second transmissive conductive layer 220, a corresponding region within the emissive layer 215 is energized to emit light, forming a pixel 250. Such a selected pixel is individually and uniquely addressable by selection of the corresponding first and second electrodes, such as through row and column addressing known in the LCD display and semiconductor memory fields. More particularly, selection of a first electrode, as a row, and a second electrode, as a column, through application of corresponding electrical potentials, will energize the region of the emissive layer 215 approximately or substantially at the intersection of the first and second electrodes, as illustrated in FIG. 6, providing addressability at a pixel level. With the addition of a color layer, such intersections may correspond to a particular color (e.g., red, green or blue) which may be combined with other addressed pixels to create any selected color combination, providing addressing at a subpixel level.

It will be apparent to those of skill in the art that, in addition to or in lieu of row and column pixel/subpixel addressing, additional addressing methods are also available and are within the scope of the present invention. For example, while not separately illustrated, the various embodiments of the present invention may be configured to provide a form or version of raster scanning or addressing.

In addition, it will also be apparent to those of skill in the electronics and printing arts that the various first, second and/or third conductive layers, and the various dielectric layers, of any of the embodiments of the invention, may be applied or printed in virtually unlimited patterns in all three spatial dimensions with accurate registration and alignment. For example, and as discussed below with respect to FIG. 11, the various conductive layers may be applied within other layers, in the nature of an electronic "via" in the depth or "z" direction, to provide for accessing and energizing second or third conductive layers from the same layer as the first conductive layer, to provide addition methods for individual pixel and subpixel addressing.

Figure 9:
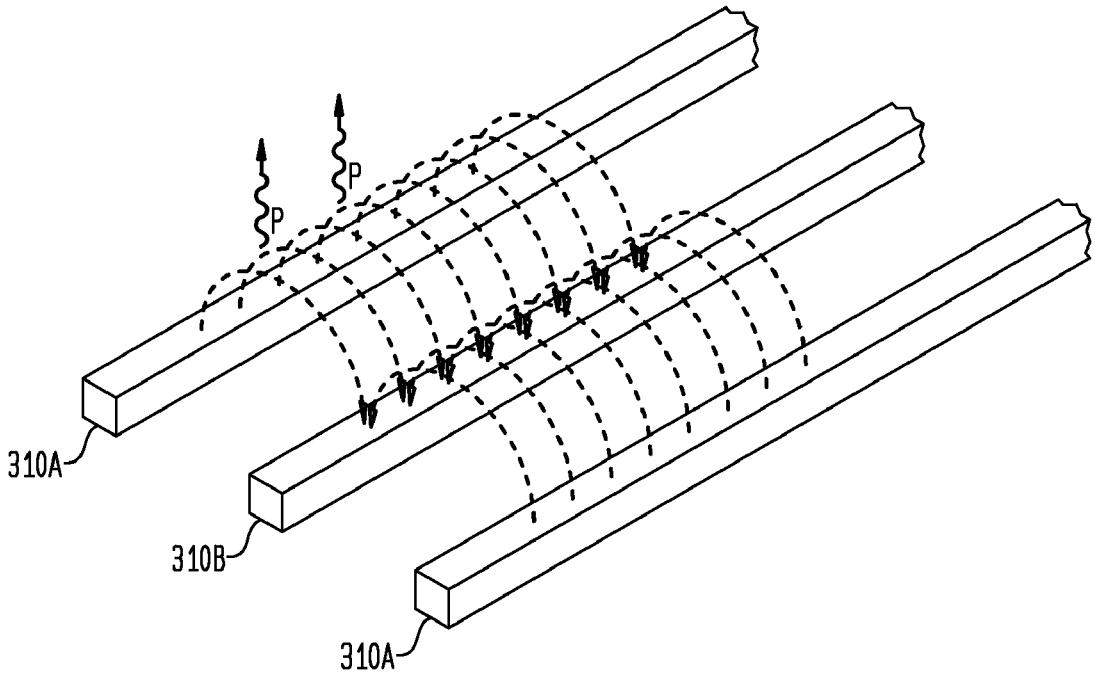
FIG. 9 is a perspective view of an emissive region of the third exemplary embodiment in accordance with the teachings of the present invention.
Figure 7:
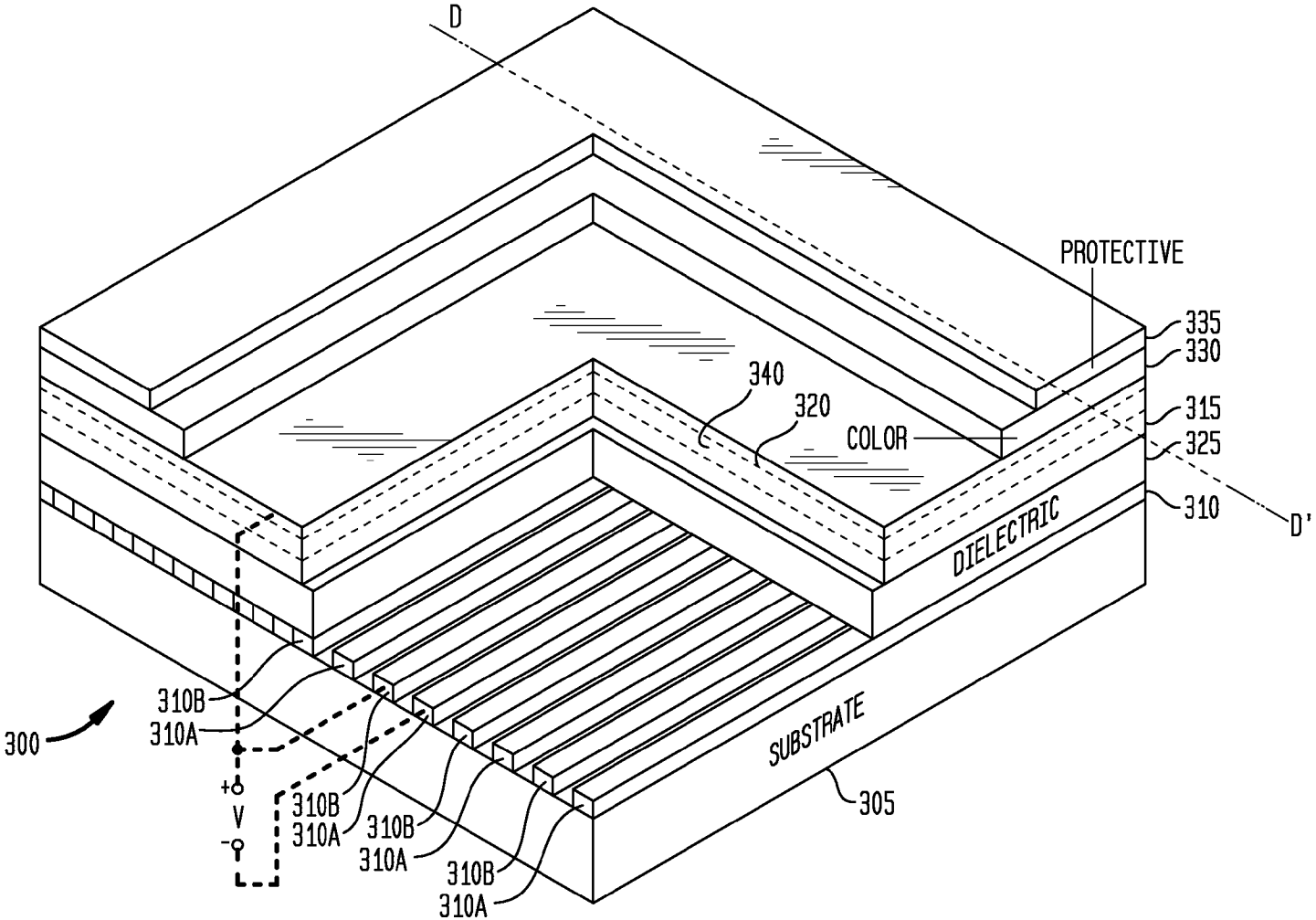
FIG. 7 is a perspective view of a third exemplary apparatus embodiment in accordance with the teachings of the present invention.
Figure 8:
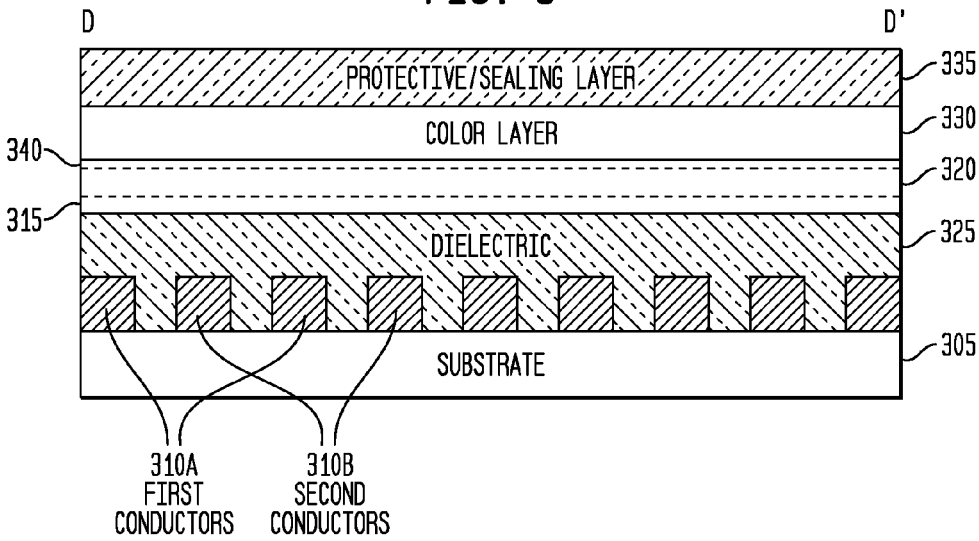
FIG. 8 is a cross-sectional view of the third exemplary apparatus embodiment in accordance with the teachings of the present invention.

FIG. 7 is a perspective view of a third exemplary apparatus embodiment 300 in accordance with the teachings of the present invention. FIG. 8 is a cross-sectional view of the third exemplary apparatus embodiment 300 in accordance with the teachings of the present invention, through the D-D' plane of FIG. 7. FIG. 9 is a perspective view of an emissive region of the third exemplary embodiment 300 in accordance with the teachings of the present invention.

Referring to FIGS. 7-9, the apparatus 300 includes different structures for the first conductive layer 310, and does not include a third conductive layer. The first conductive layer 310 and the second conductive layer 320 may be formed of the same materials as their respective counterparts previously discussed (the first conductive layers 110, 210 and second conductive layer 120, 220). Also, the remaining layers of apparatus 300, namely, the substrate layer 305, the dielectric layers 325 and 340, the emissive layer 315, the color layer 330, sealing and/or topological leveling layers 135, and coating layer 335, may be formed of the same materials, may have the same configuration as, and may otherwise be identical to their respective counterparts (substrates 105, 205, dielectric layers 125, 225, 140, 240, emissive layers 115, 215, color layer 130, 230, sealing and/or topological leveling layers 135, and coating layer 135, 235) previously discussed.

Referring to FIGS. 7 and 8, the first conductive layer 310 is also formed as a plurality of electrically isolated (or insulated) electrodes, such as in the form of strips or wires, which also may be spaced apart. While illustrated as straight, parallel electrodes, it should be understood that the electrodes may have a wide variety of shapes and configurations, such as sinusoidal, provided adjacent electrodes are electrically isolated from each other. The electrodes of the conductive layer 310 are divided into two groups, first conductors or electrodes 310A, and second conductors or electrodes 310B. One of the groups (310A or 310B) is electrically coupled to the second transmissive layer 320. Prototypes have demonstrated that when a voltage difference is applied between or across the first electrodes 310A and second electrodes 310B, with one set of the electrodes (310A or 310B (exclusive or)) electrically coupled to the second transmissive layer 320, the emissive layer 315 is energized and emits light, illustrated using electric field (dashed) lines in FIG. 9. As the emitted light passes through the optional color layer 330 and optional protective layer 335, the apparatus 300 is adapted to operate and is capable of operating as a light emitting display.

In another exemplary embodiment, the first conductive layer 110 is implemented as a plurality of independent electrodes, with a first electrode electrically isolated from a second electrode, and with the second electrode utilized to energize the second, transmissive conductive layer 120 and any third conductive layer 145. Such an electrode arrangement is illustrated in FIGS. 19 and 20. Such a plurality of independent electrodes forming the first conductive layer 110 may be repeated as separate regions of the display, such as to provide independent illumination of different display areas, in any pattern or sequence. For example, a first region may be illuminated and then powered off, followed by illumination of a second region, which is then powered off, followed by illumination of a third region, etc. This creation of multiple, independent electrodes, all within the first conductive layer 110, which are further utilized to contact from below and energize the second, transmissive conductive layer 120 and any third conductive layer 145, is new and novel.

Figure 10:
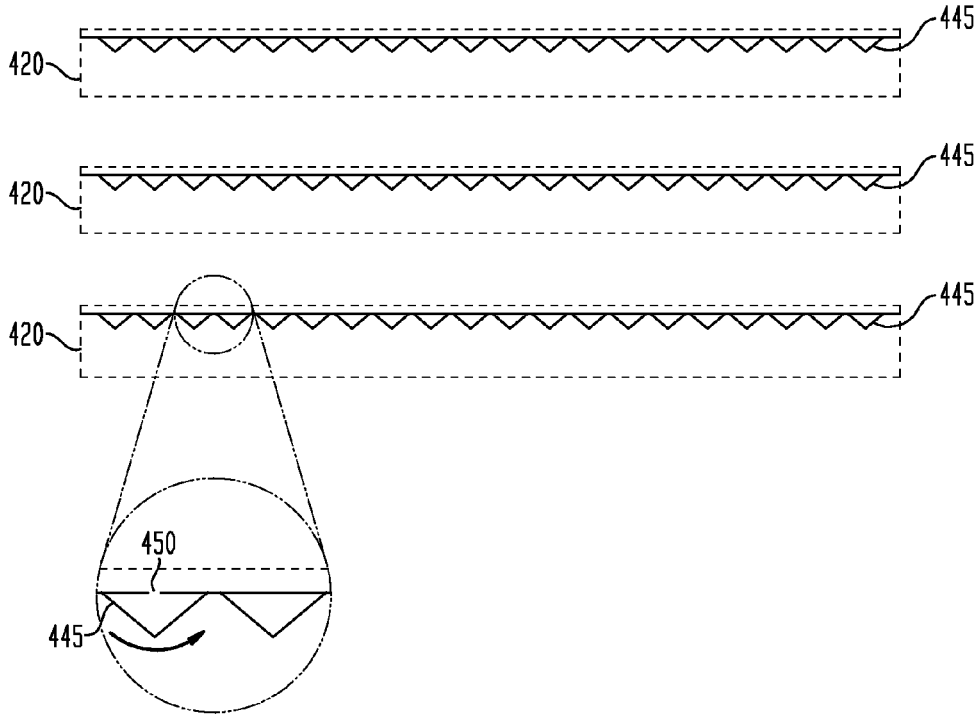
FIG. 10 is a top view of a third conductor disposed within a second, transmissive conductor of the various exemplary embodiments in accordance with the teachings of the present invention.

FIG. 10 is a top view of an exemplary embodiment of a third conductor (conductive layer) 445 disposed within a second, transmissive conductor (conductive layer) 420 of the various exemplary embodiments in accordance with the teachings of the present invention. As illustrated, the third conductive layer 445, which also may be printed using a conductive ink or conductive polymer, such as those discussed above, provides two conductive paths in any particular region, throughout the length of the particular (electrically isolated) second transmissive conductive layer 420. In the event a gap (open circuit) 450 occurs in one of the conductive paths, current can flow through the second path, providing redundancy for increased robustness. In another exemplary embodiment, the third conductive layer 145 may be implemented having a "ladder" form of two substantially parallel wires, each having a plurality of perpendicular connections to the other wire, also utilizing a conductive ink or conductive polymer. In other exemplary embodiments, the third conductive layer 145 may be implemented as a single wire or as an interconnected grid, also utilizing a conductive ink or conductive polymer.

Figure 11:
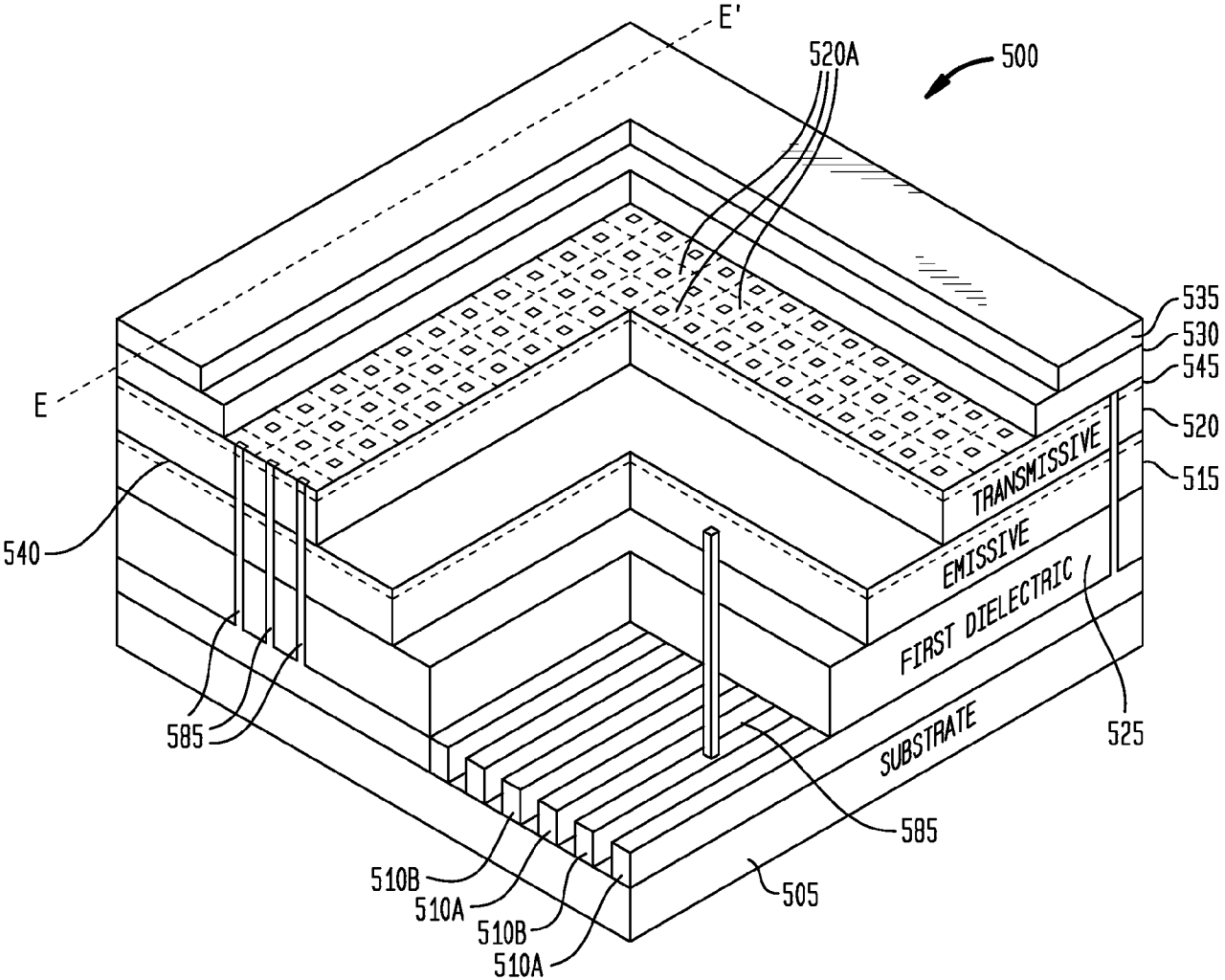
FIG. 11 is a perspective view of a fourth exemplary apparatus embodiment in accordance with the teachings of the present invention.
Figure 12:
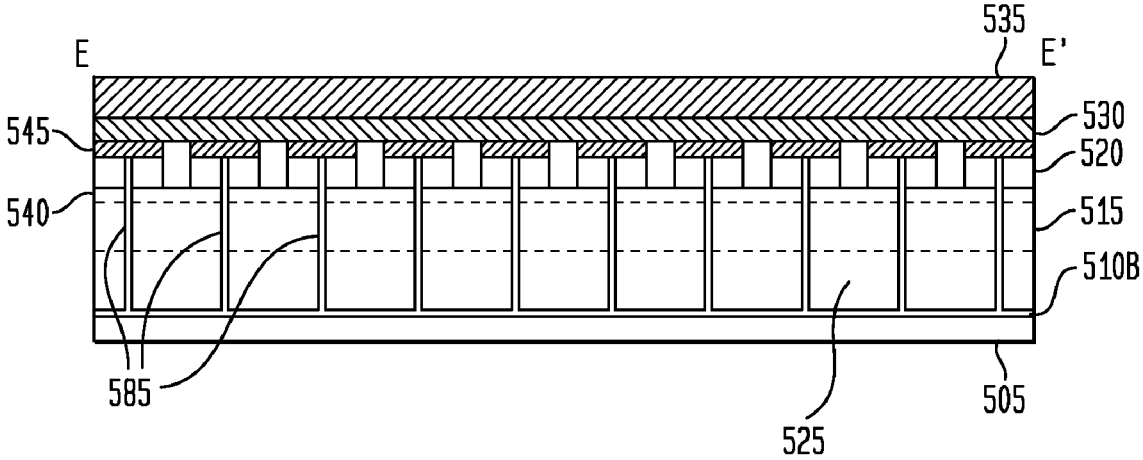
FIG. 12 is a cross-sectional view of the fourth exemplary apparatus embodiment in accordance with the teachings of the present invention.

FIG. 11 is a perspective view of a fourth exemplary apparatus embodiment 500 in accordance with the teachings of the present invention. FIG. 12 is a cross-sectional view of the fourth exemplary apparatus embodiment in accordance with the teachings of the present invention, through the E-E' plane of FIG. 11. Referring to FIGS. 11 and 12, the apparatus 500 includes many of the layers previously discussed, namely, the substrate layer 505, the dielectric layers 525 and 540, the emissive layer 515, the color layer 530, sealing and/or topological leveling layers 135, and coating layer 535, may be formed of the same materials, may have the same configuration as, and may otherwise be identical to their respective counterparts (substrates 105, 205, 305, dielectric layers 125, 140, 225, 240, 325, 340, emissive layers 115, 215, 315, color layer 130, 230, 330, and coating layer 135, 235, 335) previously discussed. In addition, the first conductive layer 510A and 510B, the second conductive layer 520, and the third conductive layer 545, may be formed of the same materials previously discussed for their respective counterparts (first conductive layer 110, 210, 310A, 310B, the second conductive layer 120, 220, 320, 420, and the third conductive layer 145, 245, 345, 445). Apparatus 500 is also similar to 300, insofar as the first conductive layer 510 is comprised of a first group of electrodes 510A, and a second group of electrodes 510B, which are electrically isolated from each other.

Continuing to refer to FIGS. 11 and 12, apparatus 500 provides for the second conductive layer 520 and third conductive layer 545 to be formed into small regions (or pixels) 520A, which may be continuous or abutting or which may be electrically isolated or insulated from each other (such as through additional dielectric material being included in that layer). Different regions 520A of the second conductive layer 520 and third conductive layer 545 are coupled to one of the two groups of electrodes of the first conductive layer 510, illustrated as connected through the second group of electrodes 510B, through "via" connections 585. These via connections 585 may be built up through the intervening layers (525, 515, 540) through printing corresponding layers of a conductive ink, for example, or other fabrication techniques, within these other intervening layers, providing a stacking or otherwise vertical arrangement to form an electrically continuous conductor. This apparatus 500 configuration allows selective energizing of the second conductive layer 520 and third conductive layer 545, on a regional or pixel basis, through electrical connections made at the level of the first conductive layer 510.

Figure 13:
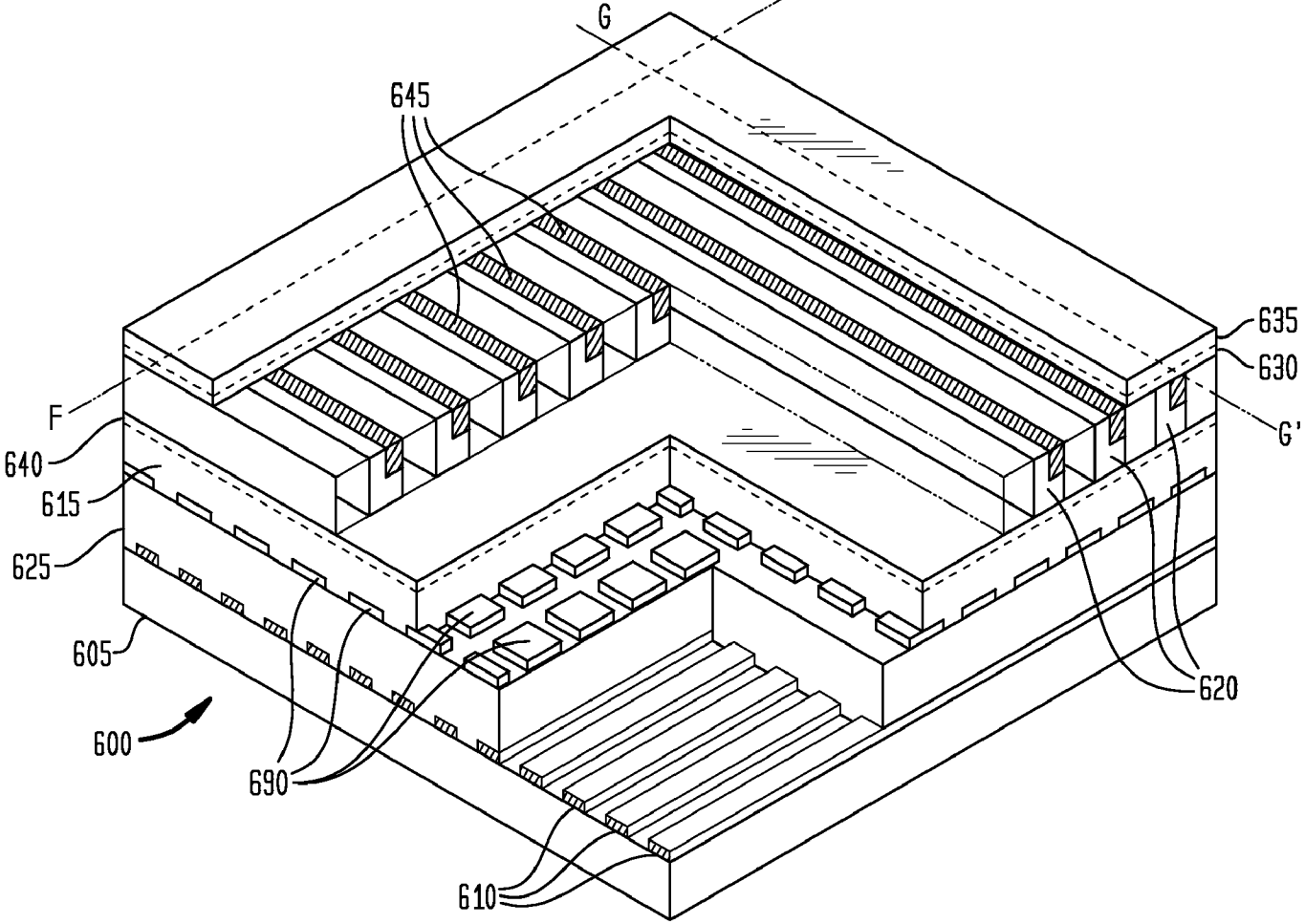
FIG. 13 is a perspective view of a fifth exemplary apparatus embodiment in accordance with the teachings of the present invention.
Figure 14:
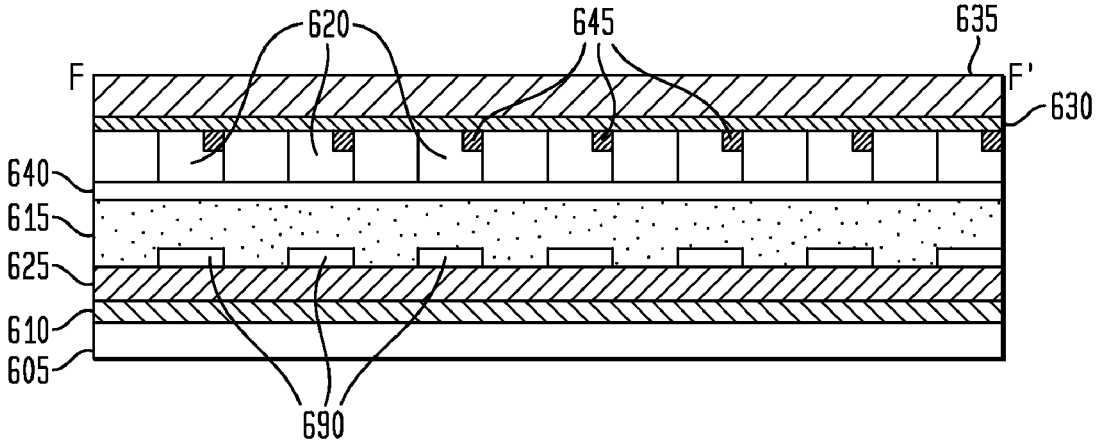
FIG. 14 is a cross-sectional view of the fifth exemplary apparatus embodiment in accordance with the teachings of the present invention.
Figure 15:
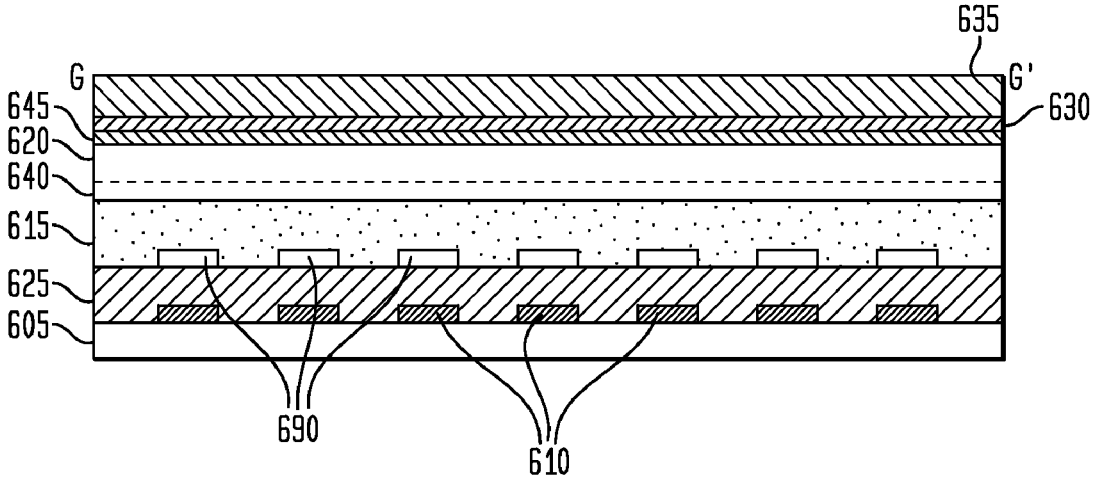
FIG. 15 is a cross-sectional view of the fifth exemplary apparatus embodiment in accordance with the teachings of the present invention.

FIG. 13 is a perspective view of a fifth exemplary apparatus 600 embodiment in accordance with the teachings of the present invention. FIG. 14 (or FIG. 14) is a cross-sectional view of the fifth exemplary apparatus 600 embodiment in accordance with the teachings of the present invention, through the F-F' plane of FIG. 13. FIG. 15 is a cross-sectional view of the fifth exemplary apparatus 600 embodiment in accordance with the teachings of the present invention, through the G-G' plane of FIG. 13.

Referring to FIGS. 13-15, the apparatus 600 is highly similar to apparatus 200, with the additional feature of a plurality of reflective elements or reflective interfaces (or surfaces) 690 printed or coated above the first dielectric layer 625 and below or within the emissive layer 615. In selected embodiments, each reflective interface or element 690 corresponds to a single pixel or a plurality of pixels, and effectively act as a plurality of very small mirrors. As a consequence, and more generally, each reflective interface or element is potentially electrically isolated from each other, and electrically isolated from the various first, second and third conductive layers 610, 620, 645. The apparatus 600 includes many of the layers previously discussed, namely, the substrate layer 605, the first conductive layer 610, the dielectric layers 625 and 640, the emissive layer 615, the second conductive layer 620, the third conductive layer 645, the color layer 630, sealing and/or topological leveling layers 135, and coating layer 635, which may be formed of the same materials, may have the same configuration as, and may otherwise be identical to their respective counterparts (substrates 105, 205, 305, 505, dielectric layers 125, 140, 225, 240, 325, 340, 525, 540, emissive layers 115, 215, 315, 515, color layer 130, 230, 330, 530, and coating layer 135, 235, 335, 535) previously discussed. In addition, the first conductive layer 610, the second conductive layer 620, and the third conductive layer 645, may be formed of the same materials previously discussed for their respective counterparts (first conductive layer 110, 210, 310A, 310B, 510, the second conductive layer 120, 220, 320, 420, 520, and the third conductive layer 145, 245, 345, 445, 545).

The plurality of reflective elements or interfaces 690 may be formed by an additional, fourth metal layer, using a highly reflective ink or other highly reflective material. For example, in selected embodiments, an ink having silver flakes (i.e., a flake ink) was utilized to fabricate the apparatus 600 and provide the reflective surfaces or elements 690. In other embodiments, the plurality of reflective elements or interfaces 690 may be fabricated using any material having a suitable refractive index to provide for significant reflection at the interface between the plurality of reflective elements or interfaces 690 and the emissive layer 615.

The plurality of reflective elements 690 provides two novel features of the present invention. First, when a pixel is in an on state and emitting light, the corresponding reflective interface 690 significantly increases the light output from the apparatus 600, acting like a mirror, and enhancing the brightness of the display. Second, when a pixel is in an off state and not emitting light, the corresponding reflective interface 690 provides a darkened area, providing for increased contrast. Notably, the addition of the reflective interfaces 690 does not impair the functioning of the other layers; for example, the reflective interfaces 690 do not interfere with charge accumulation at the lower boundary of the emissive layer 620 with the dielectric layer 625.

Figure 16:
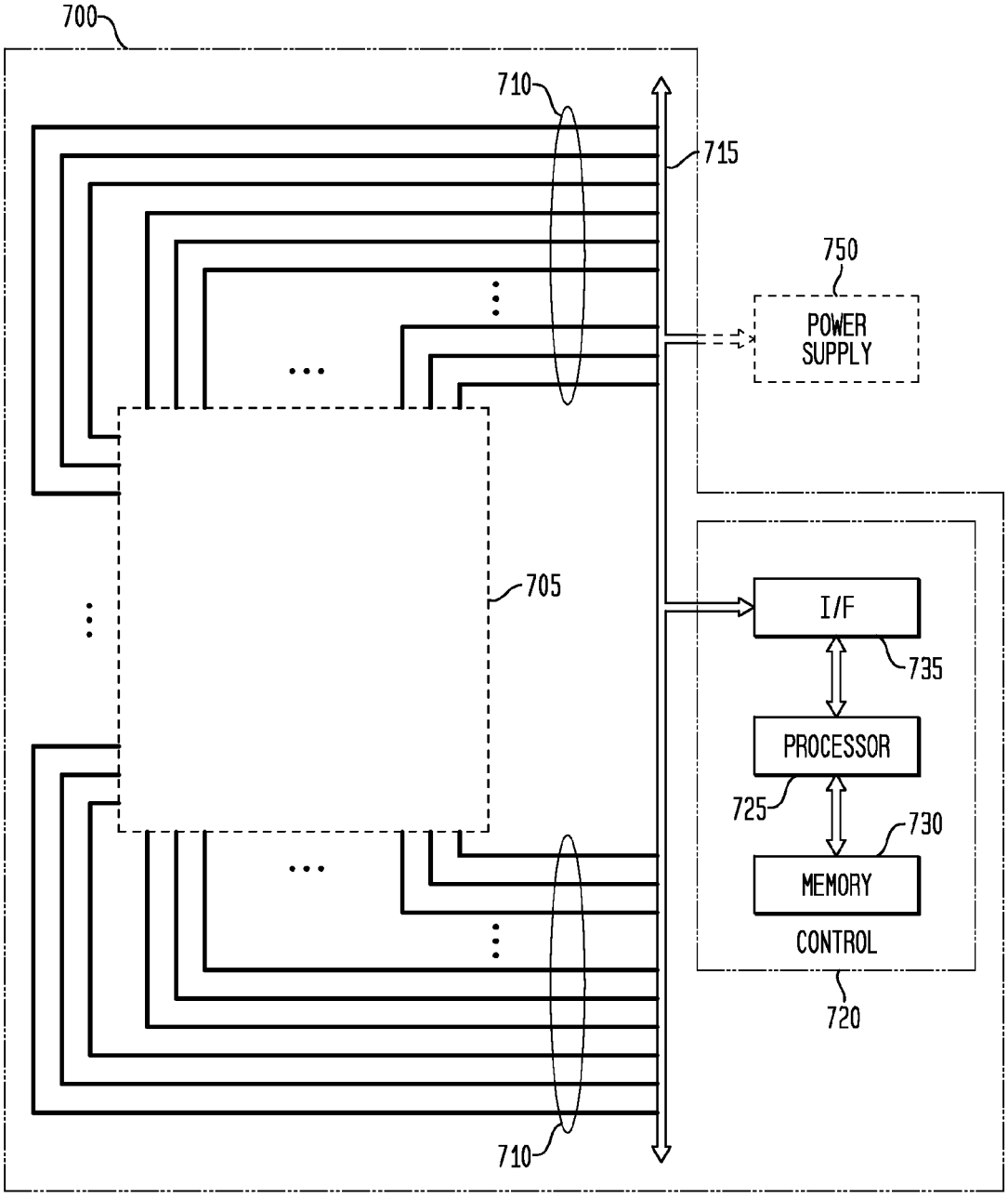
FIG. 16 is a block diagram of an exemplary system embodiment in accordance with the teachings of the present invention.

FIG. 16 is a block diagram of an exemplary system embodiment 700 in accordance with the teachings of the present invention. The system 700 includes an emissive display 705, which may be any of the various exemplary emissive display embodiments (100, 200, 300, 400, 500) of the present invention. The various first and second conductive layers are coupled through lines or connectors 710 (which may be in the form of a bus) to control bus 715, for coupling to control logic block 720, and for coupling to a power supply 750, which may be a DC power supply or an AC power supply (such as household or building power). The control logic includes a processor 725, a memory 730, and an input/output (I/O) interface 735.

The memory 730 may be embodied in any number of forms, including within any data storage medium, memory device or other storage device, such as a magnetic hard drive, an optical drive, other machine-readable storage or memory media such as a floppy disk, a CDROM, a CD-RW, a memory integrated circuit ("IC"), or memory portion of an integrated circuit (such as the resident memory within a processor IC), including without limitation RAM, FLASH, DRAM, SRAM, MRAM, FeRAM, ROM, EPROM or $E^2$PROM, or any other type of memory, storage medium, or data storage apparatus or circuit, which is known or which becomes known, depending upon the selected embodiment.

The I/O interface 735 may be implemented as known or may become known in the art, and may include impedance matching capability, voltage translation for a low voltage processor to interface with a higher voltage control bus 715, and various switching mechanisms (e.g., transistors) to turn various lines or connectors 710 on or off in response to signaling from the processor 725. The system 700 further comprises one or more processors, such as processor 725. As the term processor is used herein, these implementations may include use of a single integrated circuit ("IC"), or may include use of a plurality of integrated circuits or other components connected, arranged or grouped together, such as microprocessors, digital signal processors ("DSPs"), custom ICs, application specific integrated circuits ("ASICs"), field programmable gate arrays ("FPGAs"), adaptive computing ICs, associated memory (such as RAM and ROM), and other ICs and components. As a consequence, as used herein, the term processor should be understood to equivalently mean and include a single IC, or arrangement of custom ICs, ASICs, processors, microprocessors, controllers, FPGAs, adaptive computing ICs, or some other grouping of integrated circuits which perform the functions discussed below, with associated memory, such as microprocessor memory or additional RAM, DRAM, SRAM, MRAM, ROM, EPROM or $E^2$PROM. A processor (such as processor 725), with its associated memory, may be configured (via programming, FPGA interconnection, or hard-wiring) to control the energizing of (applied voltages to) the first conductive layers, second conductive layers, and third conductive layers of the exemplary embodiments, for corresponding control over what information is being displayed. For example, static or time-varying display information may be programmed and stored, configured and/or hard-wired, in a processor with its associated memory (and/or memory 730) and other equivalent components, as a set of program instructions (or equivalent configuration or other program) for subsequent execution when the processor is operative (i.e., powered on and functioning).

In addition to the control logic 720 illustrated in FIG. 16, those of skill in the art will recognize that there are innumerable equivalent configurations, layouts, kinds and types of control circuitry known in the art, which are within the scope of the present invention.

Figure 17A:
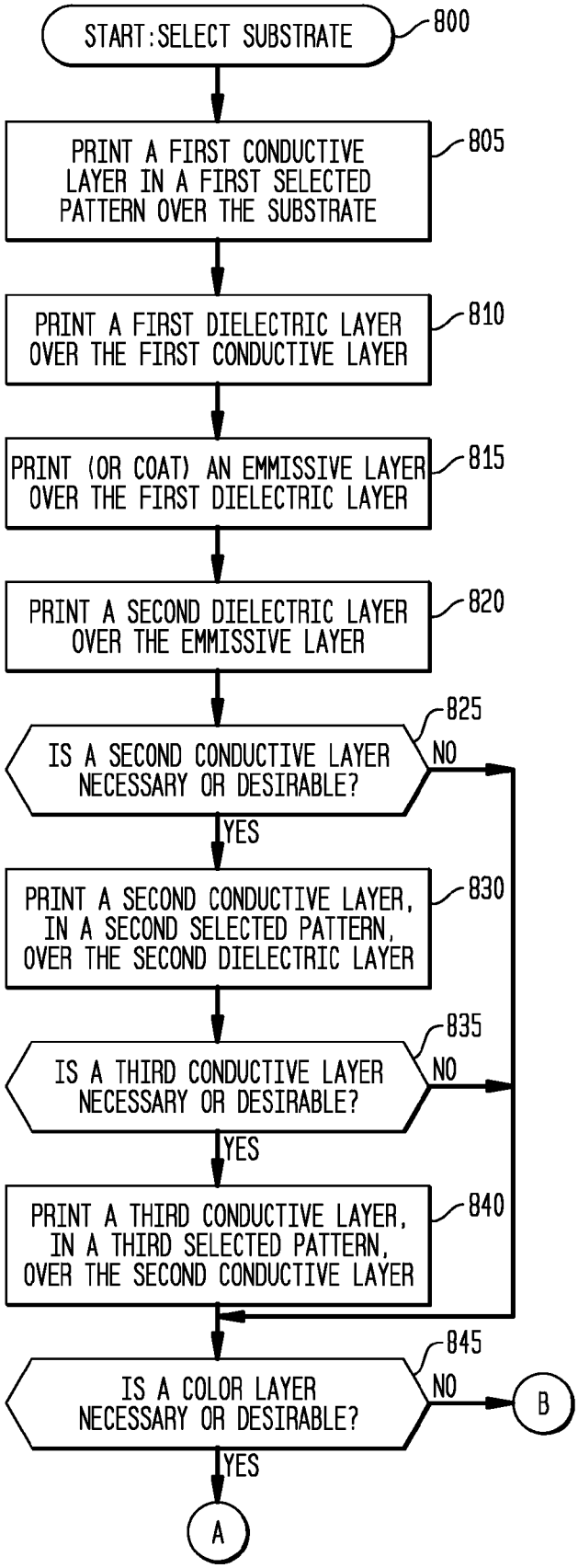
FIG. 17 is a flow chart of an exemplary method embodiment in accordance with the teachings of the present invention.
Figure 17B:
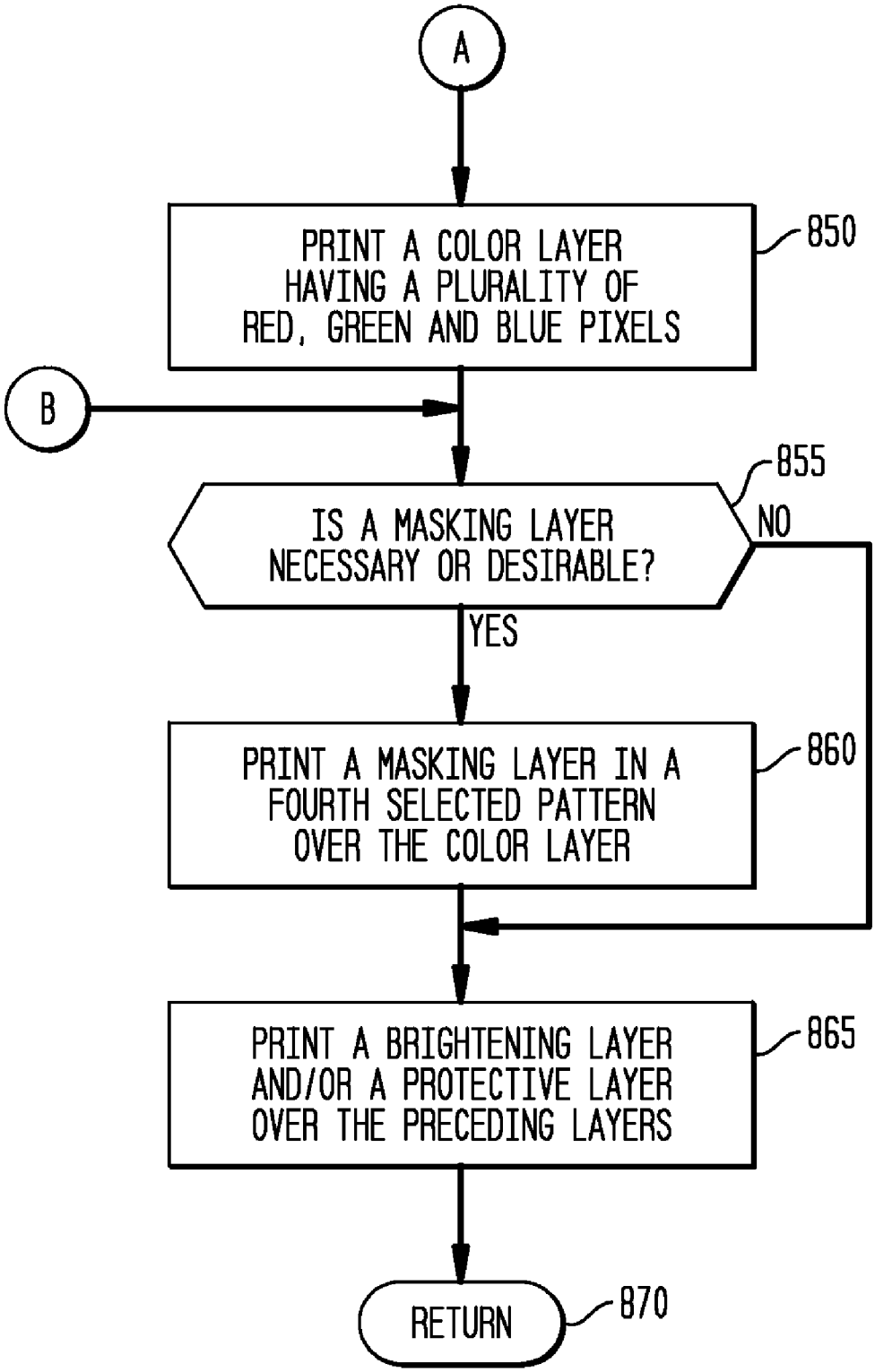

FIG. 17 is a flow chart of an exemplary method embodiment for fabrication of a printable emissive display in accordance with the teachings of the present invention. Various examples and illustrated variations are also described below. As mentioned above, the methodology may proceed with a wide variety of orders, including a "standard" build illustrated in FIG. 17 and a "reverse" build (not separately illustrated); for example, for the reverse build, the steps of FIG. 17 may be followed in reverse order, with step 865 applied to a transmissive substrate, with the penultimate step comprising application of the first conductive layer 110 (step 805), followed by addition of another sealing layer. In addition, sealing and/or topological leveling layers 135 may be applied, as may be necessary or desirable, to achieve the desired encapsulation and topological leveling effects for a selected application.

Beginning with start step 800, a substrate is selected, such as coated fiber paper, plastic, etc., and the substrate may include one or more sealing layers, either integrally or applied as additional steps. Next, in step 805, a first conductive layer is printed, in a first selected pattern, on the substrate. Various patterns have been described above, such as parallel electrodes, groups of electrodes, electrodes with vias, and so on. The step 805 of printing the first conductive layer generally consists further of printing one or more of the following compounds on the substrate: a silver conductive ink, a copper conductive ink, a gold conductive ink, an aluminum conductive ink, a tin conductive ink, a carbon conductive ink, a conductive polymer, and so on. As illustrated in the examples, this step 805 may also be repeated to increase conductive volume. As an option, a topological leveling layer may also be provided, as discussed above, in the display areas which do not have the first conductive layer. Such a topological leveling layer may also provide neutral density matching, such as using a gray lacquer to match a silver conductive ink having a gray appearance. Next, in step 810, a first dielectric layer is printed or coated over the first conductive layer, followed by printing or coating an emissive layer over the first dielectric layer in step 815 (which also may include printing of reflective interfaces), which is further followed by printing a second dielectric layer over the emissive layer in step 820. In exemplary embodiments, a second dielectric layer may be omitted, such as in the embodiments, illustrated in FIGS. 18-20. These various layers may also be built up through multiple applications (e.g., printing cycles). The first and second dielectric layers are typically comprised of one or more of the dielectric compounds previously discussed, such as barium titanate, titanium dioxide, or other similar mixtures or compounds. The emissive layer typically comprises any of the emissive compounds described above.

Depending upon the various patterns selected, second and third conductive layers may or may not be necessary. When a second conductive layer is necessary or desirable in step 825, the method proceeds to step 830, and a second conductive layer is printed, in a second selected pattern, over the second dielectric layer. Such a second conductive layer typically comprises ATO, ITO, a conductive polymer, or another suitable compound or mixture. When a second conductive layer is not necessary or desirable in step 825, the method proceeds to step 845. When a third conductive layer is necessary or desirable in step 835, the method proceeds to step 840, and a third conductive layer is printed, in a third selected pattern, over the second conductive layer. This step of printing the third conductive layer typically comprises printing a conductive ink in the third selected pattern having at least two redundant conductive paths. When a third conductive layer is not necessary or desirable in step 835, the method proceeds to step 845. Not separately illustrated, following steps 830 or 840, one or more sealing and or topological leveling layers may also be applied.

Depending upon the type of emissive display, a color layer may or may not be necessary following steps 825, 830, 835 or 840, or following application of one or more sealing layers. When a color layer is necessary or desirable in step 845, the method proceeds to step 850, and a color layer is printed over the second conductive layer, or the third conductive layer, or over a sealing layer (such as a clear lacquer), with the color layer comprising a plurality of red, green and blue pixels or subpixels, or CMYK pixels or subpixels, for example. When a color layer is not necessary or desirable in step 845, the method proceeds to step 855. Following step 850 or 845, the method determines whether a masking layer is necessary or desirable, such as for a back-lit display, step 855, and if so, a masking layer is printed in a fourth selected pattern over the color layer, with the masking layer comprising a plurality of opaque areas adapted to mask selected pixels or subpixels of the plurality of red, green and blue pixels or subpixels, step 860. When a masking layer is not necessary or desirable in step 855, and also following step 860, the method proceeds to step 865, and prints a brightening layer (such as calcium carbonate) and/or a protective or sealing layer over the preceding layers, and the method may end, return step 870.

Figure 18:
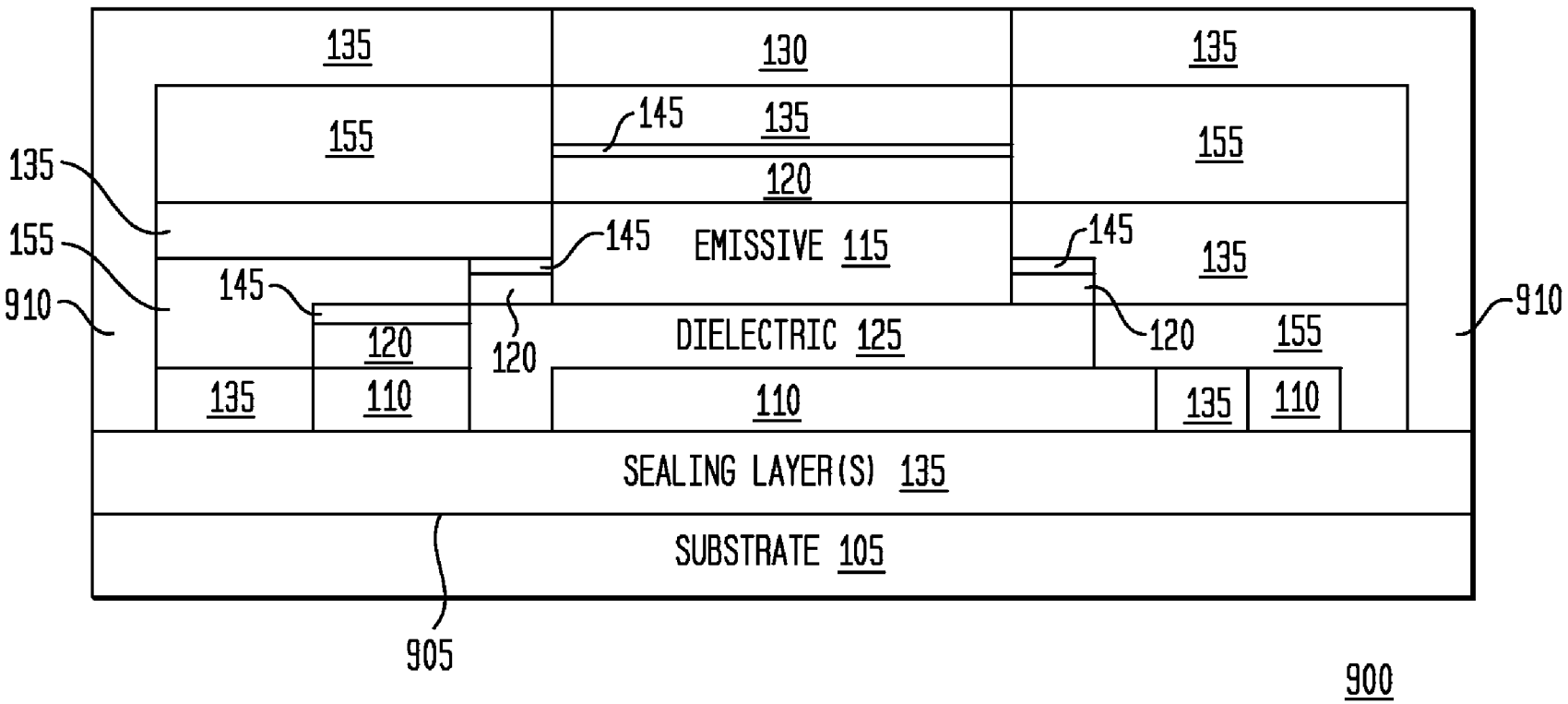
FIG. 18 is a cross-sectional view of a sixth exemplary apparatus embodiment in accordance with the teachings of the present invention.

This methodology described above may be illustrated by the following two examples consistent with the present invention, following the discussion of the sixth exemplary apparatus illustrated in FIG. 18. As mentioned above, it is to be understood that the invention is not limited in its application to the details of construction and to the arrangements of components described below in the examples.

FIG. 18 is a cross-sectional view of a sixth exemplary apparatus 900 embodiment in accordance with the teachings of the present invention, and illustrates use of exemplary sealing or protective layers (135) and mask layers (155). Such sealing provides higher performance and protects the apparatus 900 from water absorption, such as from humid air or other ambient conditions. In addition, the masking provides coverage over the first conductive layer 110, providing a better appearance. The various layers may be provided in a wide variety of patterns, such as to provide a display or signage, for example. In an exemplary embodiment, apparatus 900 provides a poster-sized display of one or more of a plurality of company logos, which may be illuminated individually or collectively. While illustrated using substrate 105, sealing or protective layers 135, mask layers 155, first conductive layer 110, dielectric layer 125, emissive layer 115, second transmissive conductive layer 120, third conductive layer 145, and color layer 130, it will be understood that any of the corresponding layers of the other embodiments may also be utilized equivalently.

In the exemplary embodiment, the substrate 105 may be pre-heated or otherwise desiccated, to drive off excess water and avoid size changes or other shrinkage during processing or printing of the various layers. As illustrated in FIG. 18, a sealing layer 135 is applied to the top 905 of the substrate 105 and edges (or sides) 910 of the apparatus 900, in addition to the top-most layer of the apparatus, with some exposure for contact with electrical leads of the various conductive layers 110, 120, 145, providing sealing of the active layers of the apparatus. The additional sealing or protective layers 135 also help to reduce cracking of the first conductive layer 110. The first conductive layer 110 is applied in a pattern to produce a plurality of conductors, one or more of which may also be utilized to provide electrical contacts to the second transmissive conductive layer 120 and/or third conductive layer 145. In an exemplary embodiment, as a second electrode for energizing the second transmissive conductive layer 120, one of the conductors of the first conductive layer 110 is also applied in two patterns, first, a halo or circumference pattern, and a grid pattern extending peripherally from the halo, to provide easier electrical connections to the second transmissive conductive layer 120. Such a halo and grid pattern for a second electrode is illustrated in FIG. 19. In addition, the size and spacing of the conductors may be determined to adjust the resistance of the layer, such as by using broken or dashed conductive lines.

One or more dielectric layers 125, mask layers 155, sealing or protective layers 135, second transmissive conductive layer 120 and/or third conductive layers 145 are applied as illustrated; in exemplary embodiments, the mask layers 155 may be a white vinyl and/or a grey lacquer, providing masking and potentially insulation of the first conductive layer 110, and may be printed, for example, at a 40% dot percentage, for intermittent coverage. The sealing layers 135 are a clear lacquer. The various sealing or protective layers 135 and mask layers 155 also serve to level or even out the surface of the apparatus 900. An emissive layer 115 is applied, along with sealing or protective layers 135. A second transmissive conductive layer 120 and third conductive layer 145 is applied over the emissive layer 115, with additional sealing or protective layers 135 and mask layers 155 (such as white vinyl) applied to the remaining areas as illustrated. Another sealing layer 135 may be applied, followed by a color layer 130, or vice-versa. Following these applications, sealing layers 135 are also applied to the sides or edges of the apparatus 900.

Figure 19:
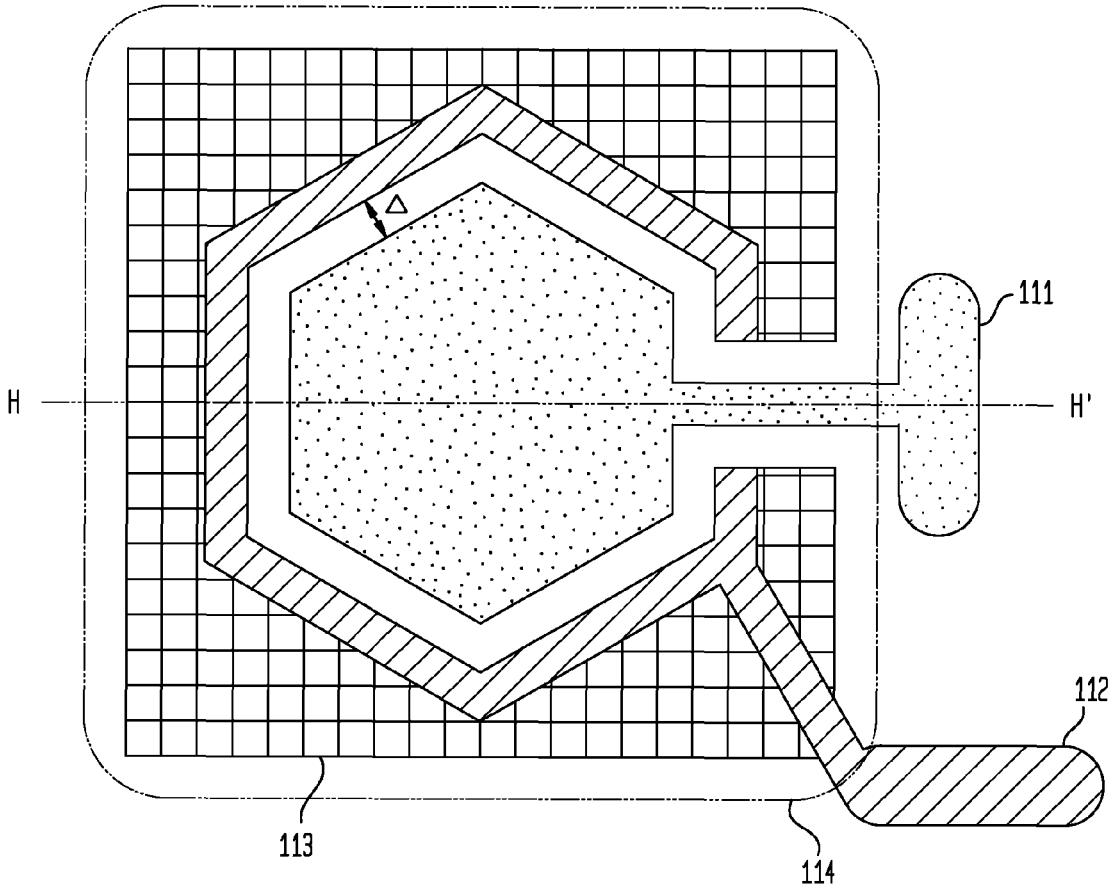
FIG. 19 is a top view of a plurality of conductive electrodes of a first conductive layer of a sixth exemplary apparatus embodiment in accordance with the teachings of the present invention.

FIG. 19 is a top view of a plurality of conductive electrodes 111, 112 of a first conductive layer 110 of a sixth exemplary apparatus embodiment in accordance with the teachings of the present invention. As illustrated in FIG. 19, within the first conductive layer 110, a first electrode 111 and a second electrode 112 are formed. In an exemplary embodiment, the second electrode 112 is spaced apart from the area to be illuminated by a predetermined and substantially constant distance (illustrated as "Δ" in FIG. 19), forming a "halo" or otherwise defining the periphery of the illuminated portion of the display. Also, the second electrode 112 is electrically coupled to or otherwise includes a conductor having grid pattern 113, which also serves to provide additional electrical contacts to the second transmissive conductive layer 120 and/or third conductive layer 145, and may provide redundancy for increased robustness. As illustrated in FIG. 20, the second electrode 112 makes contact with the second transmissive conductive layer 120 and/or third conductive layer 145 from below, from the first conductive layer 110, rather than being overlaid on top of a second transmissive conductive layer 120 in a separate application step. In addition, neither the first electrode 111 nor the second electrode 112 cross over each other within any layer, preserving significant electrical isolation. In exemplary embodiments, the various sealing layers 135 directly attached to the substrate 105 may have an area co-extensive with the substrate 105 (or may have a smaller area); at a minimum, these lower or first sealing layers 135 should be co-extensive with the upper or second sealing layers 135, providing encapsulation for the emissive and other active portions of the display. In exemplary embodiments, the various upper or second sealing layers 135 extend over most (but not all) of the plurality of electrodes of the first conductive layer 110, as illustrated by dashed line 114, while nonetheless leaving uncovered and thereby allowing for electrical contact to be made to the plurality of electrodes from a power supply (not separately illustrated).

Figure 20:
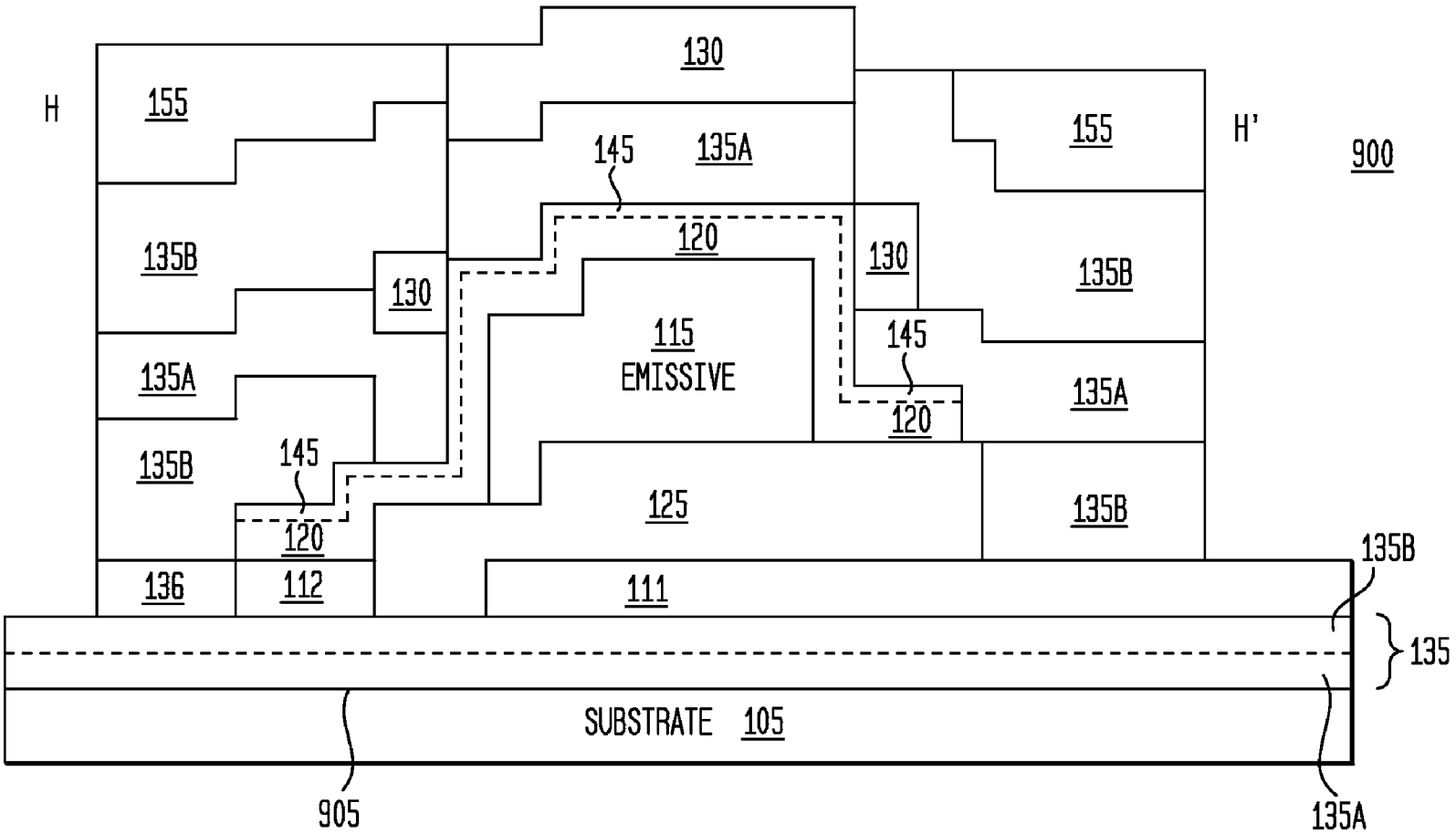
FIG. 20 is a more detailed cross-sectional view of a sixth exemplary apparatus embodiment in accordance with the teachings of the present invention.

FIG. 20 is a more detailed cross-sectional view of the sixth exemplary apparatus 900 embodiment in accordance with the teachings of the present invention, and illustrates in greater detail the use of exemplary sealing or protective layers and leveling layers (135), and optional mask layers (155). As mentioned above, such sealing provides higher performance and protects the apparatus 900 from environmental conditions and other degrading forces, such as water absorption from humid air or other ambient conditions. The leveling layers are utilized for control over surface topology, also as mentioned above, and to provide a visually or optically neutral density. Also, while illustrated using substrate 105, sealing or protective layers 135, mask layers 155, first conductive layer 110, dielectric layer 125, emissive layer 115, second transmissive conductive layer 120, third conductive layer 145, and color layer 130, it will be understood that any of the corresponding layers of the other embodiments may also be utilized equivalently.

As with the structure illustrated in FIG. 18, the various illustrated layers and structures illustrated in FIG. 20 may be utilized with any of the various embodiments previously discussed. For example, the various sealing and/or topological leveling layers 135 may be utilized between any of the various pluralities of conductors of the first conductive layer 110.

In the exemplary embodiment, a sealing layer 135 is applied to the upper surface 905 of the substrate 105, with the additional layers added successively, as discussed below. As illustrated, the sealing layer 135 comprises a first layer 135A, such as a clear or colored lacquer, and a second layer 135 B, such as a vinyl layer, and may be either heat- or uv-cured. In exemplary embodiments, a clear lacquer and a white vinyl are utilized to form the first sealing layer 135 coupled to the substrate 105. The first conductive layer 110 is applied in a pattern to produce a plurality of conductors, one or more of which may also be utilized to provide electrical contacts to the second transmissive conductive layer 120 and/or third conductive layer 145. As previously discussed, in an exemplary embodiment, one of the conductors of the first conductive layer 110 is also applied in two patterns, first, a halo or circumference pattern, and a grid pattern extending peripherally from the halo, to provide easier electrical connections to the second transmissive conductive layer 120. As illustrated, the second electrode 112 makes contact with the second transmissive conductive layer 120 and/or third conductive layer 145 from below, from the first conductive layer 110, rather than being overlaid on top of a second transmissive conductive layer 120 in a separate application step. A gray lacquer 136 is applied as illustrated, to provide a leveling layer and additional sealing.

One or more dielectric layers 125 are then applied to form the illustrated pattern and topology. Next, an emissive layer 115 is applied over the dielectric layer(s) 125, followed by application of a second transmissive conductive layer 120 and/or third conductive layers 145. Various sealing and leveling layers are then applied, with a layer of white vinyl (135B) formed, followed by a clear lacquer (135A). As another alternative, a nanoparticle carbon coating may also be utilized in addition to or in lieu of the various vinyls and lacquers. A colorant layer 130 is applied, such as through a four color printing process, followed by another layer of white vinyl (135B). An additional sealing or leveling layer (or a masking layer 155) may also be provided, as previously discussed.

It should be noted that depending upon the selected substrate 105, the sealing layer 135 coupled to the substrate 105 may be omitted, with one or more sealing layers applied over the active portions of the display, such as over the emissive layer 115. For example, when a plastic or other comparatively hydrophobic or water impervious material is utilized as the substrate 105, such as a plastic-coated paper product, no sealing layer coupled to the substrate may be needed. Conversely, in a reverse build, an upper or second sealing layer (coupled to the second transmissive conductive layer 120 and/or third conductive layers 145 coupled to the emissive layer 115) may be unnecessary, while a sealing layer 135 may be needed over the first conductive layer 110.

FIGS. 18 and 20 serve to illustrate several important features of the present invention. First, sealing layers 135 are provided which substantially encapsulate the active layers of the display, particularly the emissive layer 115 (and intervening layers, such as the second, transmissive conductive layer 120 and any third conductive layer 145), providing environmental protection and increasing the robustness and longevity of the display. Second, additional layers are utilized for control over the surface topology (which are illustrated as formed from the same compounds comprising the sealing layers, although this is optional and not required). Third, such additional layers may also be utilized to create a visually neutral density, such as to provide a gray lacquer to effectively match the gray of the first conductive layer.

In the following examples, as each layer is applied, that layer is generally given sufficient time to dry or cure, depending both upon temperature, ambient (relative) humidity, and volatility of any selected solvent. For example, the various layers may be dried ambiently (approximately 72 degrees Fahrenheit (F), at 40-50% relative humidity. Depending upon the selection of binders for various layers, ultraviolet (uv) curing is also available. Various display examples (Example 2, below) have been dried at 150 degrees F., with approximately or substantially 4 hours of drying time for the dielectric layers, and approximately or substantially 1 hour of drying time for the other layers. The various signage examples (Example 1) may be dried at approximately or substantially at higher temperatures (e.g., 220 degrees F.) for a considerably shorter duration (e.g., 30 seconds). It will be understood, therefore, that a wide variety of suitable drying temperatures and durations may be determined empirically by those of skill in the art, and all such variations are within the scope of the present invention.

Two other techniques have also been incorporated into the following examples. As mentioned above, proper alignment (registration) between layers, depending upon the selected embodiment, may be important. As a consequence, when multiple layers of conductive material (ink) are applied in order to increase the conductive volume, each subsequent layer is made slightly smaller (choked) than the immediately preceding conductive layer to reduce the probability of registration error (in which a conductive material would be printed beyond the bounds of the original conductive trace).

Second, as drying may cause shrinkage, the substrate and any additional or intervening layers may be remoisturized, allowing the substrate and any additional layers to re-swell to substantially its or their original size before applying the next layer. In the examples discussed below, such remoisturizing is employed during the applications of the conductive layers, to avoid any subsequent swelling of the materials after the conductive inks have set (which could potentially result in an open circuit). Alternatively, using the various sealing layers, separate drying of the substrate 105 may be unnecessary, and those corresponding steps may be eliminated.

EXAMPLE 1

Signage

Using either continuous roll or sheeted substrate, a surface finish coating is applied, in order to smooth the surface of the substrate (on a micro or detailed level). A conductive ink is patterned on the "live" area of the substrate (i.e., the area to be illuminated) by offset printing, and allowed to dry as discussed above. Multiple applications of conductive ink are applied, using the alignment (reduced or choked patterning), and the remoisturizing discussed above. One or more dielectric layers are applied as a patterned coating on the area to be illuminated, and allowed to dry as discussed above. A polymer reflective (or mirror) layer is applied and cured through ultraviolet exposure, providing the plurality of reflective elements or interfaces. An emissive phosphor is applied as one or more patterned coatings on the area to be illuminated, and allowed to dry as discussed above. A clear ATO coating is applied as a patterned coating on the area to be illuminated, and allowed to dry or cure as discussed above, e.g., by brief, mild heating. Fluorescent RGB or specialty colors are then applied to the appropriate areas to be illuminated, and allowed to dry as discussed above. CMYK colorants are printed via a halftone process or as spot colors to form the remaining (non-illuminated) are of the sign. A polymer sealant is applied via coating and cured via ultraviolet exposure.

EXAMPLE 2

Display

Also using either continuous roll or sheeted substrate, a surface finish coating is applied, in order to smooth the surface of the substrate (on a micro or detailed level). A conductive ink is patterned as rows (or columns) on this substrate surface using flexographic printing, and allowed to dry as discussed above. Multiple applications of conductive ink are applied, using the alignment (reduced or choked patterning), and the remoisturizing discussed above. One or more dielectric layers are applied as a coating bounded by the area of the active display, and allowed to dry as discussed above. A polymer reflective (or mirror) layer is applied and cured through ultraviolet exposure, providing the plurality of reflective elements or interfaces. An emissive phosphor is applied as one or more coatings bounded by (and slightly smaller than) the area of the active display of the dielectric layer (i.e., choked or slightly reduced area to be within the boundaries of the dielectric layer), and allowed to dry as discussed above. A conductive ink is patterned as columns (or rows) on this substrate surface using flexographic printing, and allowed to dry as discussed above. Following remoisturizing, each conductive ink trace is patterned with multiple apertures or bends, such as those described above with respect to FIG. 10, to substantially allow maximum or sufficient edge length. A clear ATO conductor is applied through flexographic printing, patterned as columns (or rows) over the top conductive ink trace and also choked to be within each column (or row), and allowed to dry or cure as discussed above, e.g., by brief, mild heating. Fluorescent RGB colors are then applied at each intersection of a top and bottom conductive ink (pixel or subpixel) as color triads, and allowed to dry as discussed above. A polymer sealant is applied via coating and cured via ultraviolet exposure.

Numerous advantages of the present invention are readily apparent. As a light emitting display, the various embodiments of the invention may be fabricated using any of a plurality of conventional and comparatively inexpensive printing or coating processes, rather than through the highly involved and expensive semiconductor fabrication techniques, such as those utilized to make LCD displays, plasma displays, or ACTFEL displays. The various embodiments of the invention may be embodied using comparatively inexpensive materials, such as paper and phosphors, substantially reducing production costs and expenses.

The various embodiments have a flat form factor and are scalable, virtually limitlessly, and are highly robust. For example, the various embodiments may be scaled up to have a form factor of wallpaper, billboard or larger size, or down to cellular telephone or wristwatch display size. The various embodiments also provide a wide range of selectable resolutions.

From the foregoing, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

It is claimed:

1. An emissive display comprising:

an embossed substrate comprising a first sealing layer and a plurality of peaks forming a corresponding plurality of spaced apart valleys;

a first plurality of conductors coupled to the embossed substrate, each conductor of the first plurality of conductors within a corresponding valley of the plurality of spaced apart valleys of the embossed substrate;

a dielectric layer coupled to a first conductor of the first plurality of conductors;

an emissive layer coupled to the dielectric layer;

a third, optically transmissive conductor coupled to the emissive layer and coupled to a second conductor of the first plurality of conductors; and a second sealing layer coupled to the third, optically transmissive conductor or to any intervening layer, the second sealing layer further coupled to the first sealing layer.

2. The emissive display of claim 1, wherein the embossed substrate and the first sealing layer are integrally combined.

3. The emissive display of claim 1, wherein the embossed substrate further comprises at least one valley, of the plurality of spaced apart valleys, having a halo configuration.

4. The emissive display of claim 1, wherein the embossed substrate further comprises at least one valley, of the plurality of spaced apart valleys, having a grid configuration.

5. The emissive display of claim 1, wherein the first sealing layer and the second sealing layer are comprised of a hydrophobic compound.

6. The emissive display of claim 1, wherein the first sealing layer and the second sealing layer are comprised of a lacquer-based compound.

7. The emissive display of claim 1, wherein the first sealing layer and the second sealing layer are further comprised of a colorant.

8. The emissive display of claim 7, wherein the colorant has a visually neutral density substantially matching a coloration of an adjacent region of the emissive display.

9. The emissive display of claim 7, wherein the colorant has a visually neutral density substantially matching a coloration of the first plurality of conductors.

10. The emissive display of claim 1, further comprising a first topological leveling layer, the first topological leveling layer coupled substantially adjacent to a periphery of the emissive layer, or coupled to the first plurality of conductors, or coupled to the dielectric layer, or coupled to both the first plurality of conductors and the dielectric layer.

11. The emissive display of claim 10, wherein the first topological leveling layer comprises a vinyl-based compound or a lacquer-based compound.

12. The emissive display of claim 10, further comprising:

a second topological leveling layer comprised of a vinyl-based compound or a lacquer-based compound.

13. The emissive display of claim 1, wherein a portion of the second conductor of the first plurality of conductors is spaced apart from a periphery of the first conductor of the first plurality of conductors by a substantially uniform and predetermined distance.

14. The emissive display of claim 1, wherein the second conductor of the first plurality of conductors further comprises a unitary and continuous conductor having a halo and a grid configuration.

15. The emissive display of claim 1, further comprising:

a fourth conductor coupled to the third, optically transmissive conductor, the fourth conductor having an impedance comparatively lower than an impedance of the third, optically transmissive conductor.

16. The emissive display of claim 15, wherein the fourth conductor comprises at least one conductive path and is formed from a conductive ink or a conductive polymer.

17. The emissive display of claim 1, wherein an intervening layer comprises at least one fluorescent colorant or color conversion material.

18. The emissive display of claim 1, wherein an intervening layer comprises a plurality of red, green and blue pixels or subpixels.

19. The emissive display of claim 18, further comprising:

a masking layer coupled to the intervening layer, the masking layer comprising a plurality of opaque areas to mask selected pixels or subpixels of the plurality of red, green and blue pixels or subpixels.

20. The emissive display of claim 1, wherein the first plurality of conductors are spaced apart and disposed substantially parallel in a first orientation, and wherein the third, optically transmissive conductor further comprises:

a second plurality of optically transmissive conductors, the second plurality of optically transmissive conductors spaced apart and disposed substantially parallel in a second, different orientation.

21. The emissive display of claim 1, wherein the first plurality of conductors comprise a cured conductive ink or a cured conductive polymer.

22. The emissive display of claim 1, wherein the emissive layer comprises a phosphor.

23. The emissive display of claim 1, wherein the third, second, optically transmissive conductor comprises antimony tin oxide, indium tin oxide, or polyethylene-dioxithiophene.

24. An emissive display comprising:

an optically transmissive substrate;

at least one color layer coupled to the optically transmissive substrate;

a plurality of conductors, a first, optically transmissive conductor of the plurality of conductors coupled to the at least one color layer or to the optically transmissive substrate;

an emissive layer coupled to the first, optically transmissive conductor;

a dielectric layer coupled to the emissive layer;

a second conductor of the plurality of conductors coupled to the first, optically transmissive conductor, the second conductor comprising a unitary and continuous conductor having a halo and a grid configuration;

a third conductor of the plurality of conductors is coupled to the dielectric layer; and a first sealing layer coupled to the second and third conductors of the plurality of conductors and to the optically transmissive substrate.

25. The emissive display of claim 24, wherein the first sealing layer and the optically transmissive substrate are comprised of one or more substantially hydrophobic compounds.

26. The emissive display of claim 24, further comprising a topological leveling layer, wherein the topological leveling layer comprises a vinyl-based compound or a lacquer-based compound.

27. The emissive display of claim 24, further comprising a second sealing layer coupled to the first, optically transmissive conductor or to the emissive layer.

28. The emissive display of claim 27, wherein the second sealing layer is comprised of a colorant having a visually neutral density substantially matching a coloration of its adjacent region of the emissive display.

29. The emissive display of claim 24, wherein the emissive layer comprises at least one semiconductor, or a phosphor, or a combination of at least one semiconductor and a phosphor.

30. The emissive display of claim 24, wherein a portion of the second conductor of the plurality of conductors is spaced apart from a periphery of the third conductor of the plurality of conductors by a substantially uniform and predetermined distance.

31. The emissive display of claim 24, further comprising:

a fourth conductor coupled to the first, optically transmissive conductor, the fourth conductor having an impedance comparatively lower than an impedance of the first, optically transmissive conductor.

32. The emissive display of claim 24, wherein the first, optically transmissive conductor comprises antimony tin oxide, indium tin oxide, or polyethylene-dioxithiophene.

33. The emissive display of claim 24, wherein the first sealing layer is integrally combined with a second substrate to form an embossed substrate.

34. The emissive display of claim 24, wherein the optically transmissive substrate is a polymeric material.

35. The emissive display of claim 33, wherein the embossed substrate further comprises a plurality of peaks forming a corresponding plurality of spaced apart valleys.

36. The emissive display of claim 35, wherein the second and third conductors of the plurality of conductors are disposed within corresponding valleys of the plurality of spaced apart valleys of the embossed substrate.

37. An emissive display comprising:

a substrate integrally combined with a first sealing layer;

a plurality of conductors, a first conductor of the plurality of conductors comprising a unitary and continuous conductor having a halo and a grid configuration spaced apart from a second conductor of the plurality of conductors;

a dielectric layer coupled to the second conductor of the plurality of conductors;

an emissive layer coupled to the dielectric layer;

a third, optically transmissive conductor of the plurality of conductors coupled to the emissive layer and coupled to the first conductor of the plurality of conductors; and a second sealing layer coupled to the second, optically transmissive conductor or to any intervening layer, the second sealing layer further coupled to the first sealing layer or to the substrate.

38. The emissive display of claim 37, wherein the substrate and the first sealing layer further comprise an embossed substrate having a plurality of peaks forming a corresponding plurality of spaced apart valleys.

39. The emissive display of claim 37, wherein the first sealing layer and the second sealing layer are comprised of a hydrophobic compound.

40. The emissive display of claim 37, wherein the first sealing layer and the second sealing layer are comprised of a lacquer-based compound.

41. The emissive display of claim 37, further comprising at least one topological leveling layer, wherein the at least one topological leveling layer is coupled substantially adjacent to a periphery of the emissive layer, or coupled to the first plurality of conductors, or coupled to the dielectric layer, or coupled to both the first plurality of conductors and the dielectric layer.

42. The emissive display of claim 41, wherein the at least one topological leveling layer comprises a vinyl-based compound or a lacquer-based compound.

43. The emissive display of claim 37, further comprising:

a fourth conductor coupled to the third, optically transmissive conductor, the fourth conductor having an impedance comparatively lower than an impedance of the third, optically transmissive conductor.

44. The emissive display of claim 37, wherein an intervening layer comprises at least one fluorescent colorant or color conversion material.

45. The emissive display of claim 37, wherein an intervening layer comprises a plurality of red, green and blue pixels or subpixels.

46. The emissive display of claim 45, further comprising:

a masking layer coupled to the intervening layer, the masking layer comprising a plurality of opaque areas to mask selected pixels or subpixels of the plurality of red, green and blue pixels or subpixels.

47. The emissive display of claim 37, wherein the emissive layer comprises a phosphor, or at least one semiconductor, or a combination of at least one semiconductor and a phosphor.

48. The emissive display of claim 37, wherein the second, optically transmissive conductor comprises antimony tin oxide, indium tin oxide, or polyethylene-dioxithiophene.

* * * * *